US005606353A

United States Patent [19]

Mochizuki et al.

[11] Patent Number: 5,606,353

[45] Date of Patent: Feb. 25, 1997

[54] INK JET RECORDING APPARATUS

[75] Inventors: Seiji Mochizuki; Kazuhisa Kawakami; Masahiro Nakamura; Keiichi Ohshima, all of Nagano, Japan

[73] Assignee: Seiko Epson Corporation, Tokyo, Japan

[21] Appl. No.: 207,747

[22] Filed: Mar. 9, 1994

[30] Foreign Application Priority Data

Mar. 11, 1993 [JP] Japan ..... 5-077584

[51] Int. Cl.[6] ..... B41J 2/165

[52] U.S. Cl. ..... 347/23; 347/30

[58] Field of Search ..... 347/7, 30, 23, 347/19

[56] References Cited

U.S. PATENT DOCUMENTS

| | | | |
|---|---|---|---|
| 5,126,764 | 6/1992 | Miyauchi et al. | 347/104 |
| 5,132,711 | 7/1992 | Shinada et al. | 347/7 |
| 5,153,614 | 10/1992 | Yamaguchi et al. | 347/30 |
| 5,172,140 | 12/1992 | Hirabayashi et al. | 347/23 |
| 5,382,969 | 1/1995 | Mochizuki et al. | 347/23 |

FOREIGN PATENT DOCUMENTS

| | | | |
|---|---|---|---|
| 0440110 | 8/1991 | European Pat. Off. . | |
| 0452119 | 10/1991 | European Pat. Off. . | |
| 0540174 | 5/1993 | European Pat. Off. . | |
| 0552472 | 7/1993 | European Pat. Off. . | |
| 0224549 | 11/1985 | Japan | 347/7 |
| 3224955 | 9/1988 | Japan | 347/23 |

*Primary Examiner*—John E. Barlow, Jr.

*Attorney, Agent, or Firm*—Sughrue, Mion, Zinn, Macpeak & Seas

[57] ABSTRACT

An ink jet recording apparatus which includes a recording head communicated via an ink supply needle with an ink tank and including electrodes for detecting a remaining amount of ink and being responsive to a print signal for spouting ink drops to recording paper, a capping unit abutting against the front of said recording head for holding the nozzle openings in an airtight state, a suction pump for supplying negative pressure to the capping unit, a resistance value detection circuit for detecting electric resistance across the electrodes for detecting a remaining amount of ink, a reference value storage unit for storing a resistance value across the electrodes relative to the remaining amount of ink in the ink tank, a resistance value comparison unit for comparing the resistance across the electrodes with the reference value, and a pump control unit responsive to the resistance value comparison result for controlling a pulse motor driving the suction pump. The resistance value detected by the resistance value detection circuit is compared with the reference value stored in the reference value storage unit to determine whether or not an ink tank is mounted, remounted, how much ink is in the ink tank, etc. Based on the determination result, the motor is controlled by the pump control unit for selecting the suction mode of ink from the recording head.

20 Claims, 18 Drawing Sheets

LEFT SIDE

RIGHT SIDE

INK JET RECORDING APPARATUS

BACKGROUND OF THE INVENTION

The present invention relates to a device for handling ink in an ink jet recording apparatus in which a recording head is moved across the width of recording paper and jets ink drops onto the recording paper in response to print data for forming an image.

An on-demand ink jet recording apparatus which jets ink pressurized at a pressure generation chamber through a nozzle onto recording paper as ink droplets for recording print data exhibits substantial problems. Among these problems are a rise in viscosity caused by evaporation of an ink solvent from nozzle openings and print failure caused by drying of ink, adhesion of dust, and mixing of air bubbles. Thus, an ink jet recording apparatus of this type is generally provided with a capping device for sealing the nozzle openings when no printing is being performed and a device for cleaning around the nozzle openings as required.

A proposed capping device includes a slider which is moved by a carriage to a home position along a slant guide face disposed on a frame to the nozzle opening face side of a head, and a cap disposed on the surface of the slider is pressed against the recording head for sealing the nozzle openings, for example. Such an arrangement is disclosed in Japanese Patent Laid-Open No. Hei 1-125239.

For such an ink jet recording apparatus, an ink tank is furnished in cartridge form which provides a convenient ink supply. When the ink has been consumed, the ink cartridge is replaced with a new one. One such ink cartridge is disclosed in Japanese Patent Laid-Open No. Hei 2-187364, in which a porous substance forming an ink absorber is housed in the ink cartridge. Annular packing material is disposed on the tip of an ink outlet for sealing. Since ink can be easily supplied by simply changing ink cartridges, the ink cartridge is very useful in preventing pollution caused by ink leakage, etc., at the ink supply. On the other hand, the ink cartridge has a disadvantage in that air bubbles are prone to enter the ink cartridge by piston action between an ink supply needle on the main unit side and the ink outlet of the ink cartridge when the ink supply needle is inserted.

Further, because of the ease of changing the ink supply, the ink cartridge is removed and then remounted even when ink remains in the cartridge. As a result, air bubbles enter the ink cartridge by the piston action and cause print failure to occur.

SUMMARY OF THE INVENTION

It is therefore an object of the invention to provide an ink jet recording apparatus which can more perfectly perform ink handling for a recording head, such as supplying ink from an ink cartridge to the recording head, and to solve the problem of the nozzle openings clogging during printing.

To achieve this object, according to the invention, there is provided an ink jet recording apparatus comprising a recording head communicated via an ink supply member with an ink tank comprising electrodes for detecting a remaining amount of ink and being responsive to a print signal for spouting ink drops from nozzle openings to recording paper, capping means abutting against the front of the recording head for holding the nozzle openings in an airtight state, suction means for supplying negative pressure to the capping means and sucking out ink in the capping means into a waste ink tank, resistance across the electrodes for detecting a remaining amount of ink, reference value storage means for storing a resistance value across the electrodes relative to the remaining amount of ink in the ink tank as a reference value, resistance value comparison means for comparing the resistance across the electrodes with the reference value, and suction control means responsive to the resistance value comparison result for controlling the operation of the suction means.

Since the resistance of the resistance value detection means connected to the electrodes of the ink cartridge changes in response to the presence or absence of the ink cartridge and the communication state with the recording head, the resistance is compared with data in the reference value storage means to determine whether or not the ink cartridge is mounted and how much ink the ink cartridge contains. Based on the determination result, the suction mode of the suction means is selected.

DESCRIPTION OF THE PREFERRED EMBODIMENTS

Referring now to the accompanying drawings, there are shown preferred embodiments of the invention.

Figure 1:
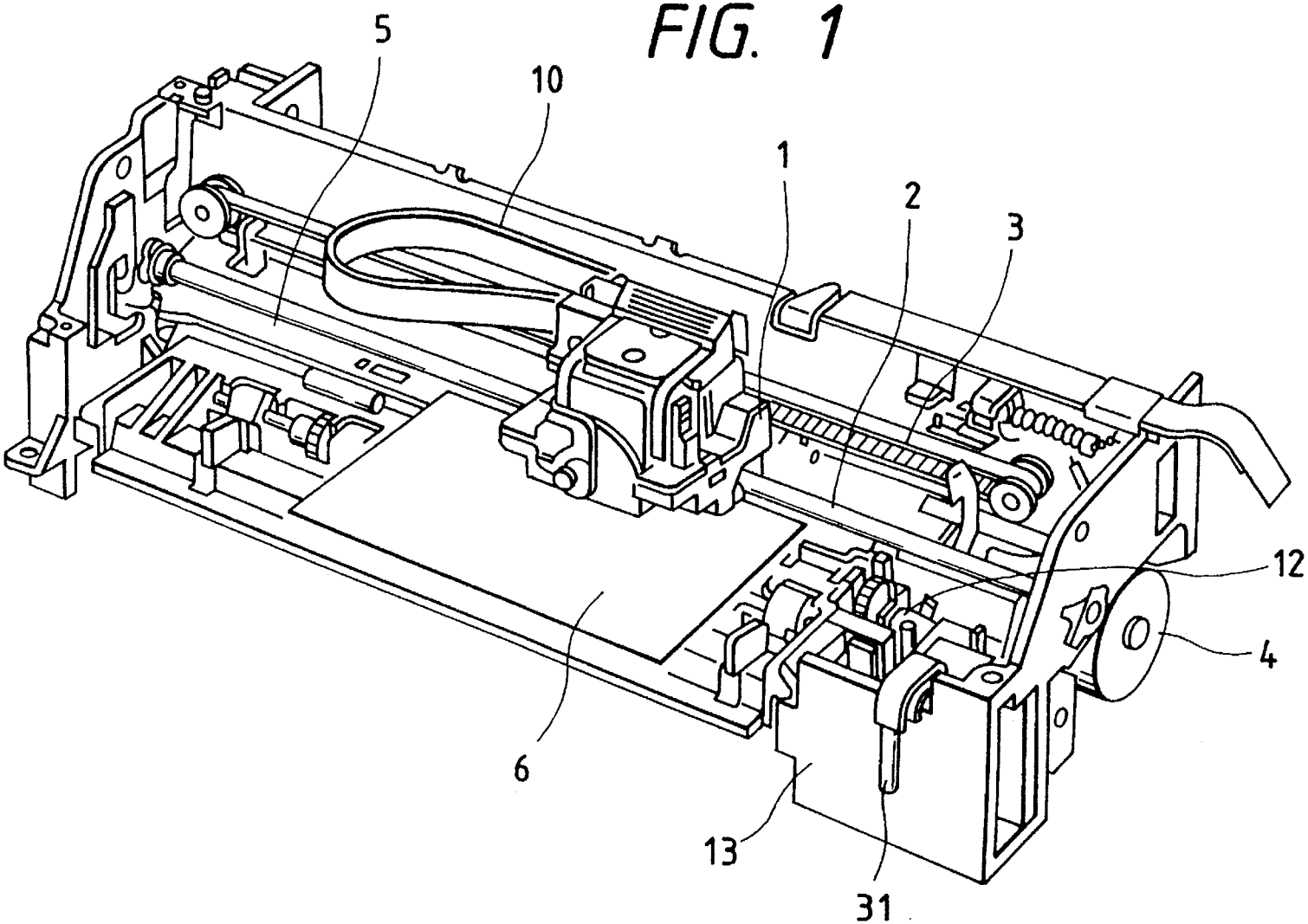
FIG. 1 is a perspective view showing the structure of the print mechanism periphery of an ink jet recording apparatus to which an ink supply device of the invention is applied.

FIG. 1 shows in perspective view the area of a print mechanism of an ink jet recording apparatus to which the invention is applied. In FIG. 1, reference numeral 1 is a carriage which is supported by a guide member 2 and is connected via a timing belt 3 to a pulse motor (not shown) and can reciprocate in parallel to a platen 5.

Figure 2:
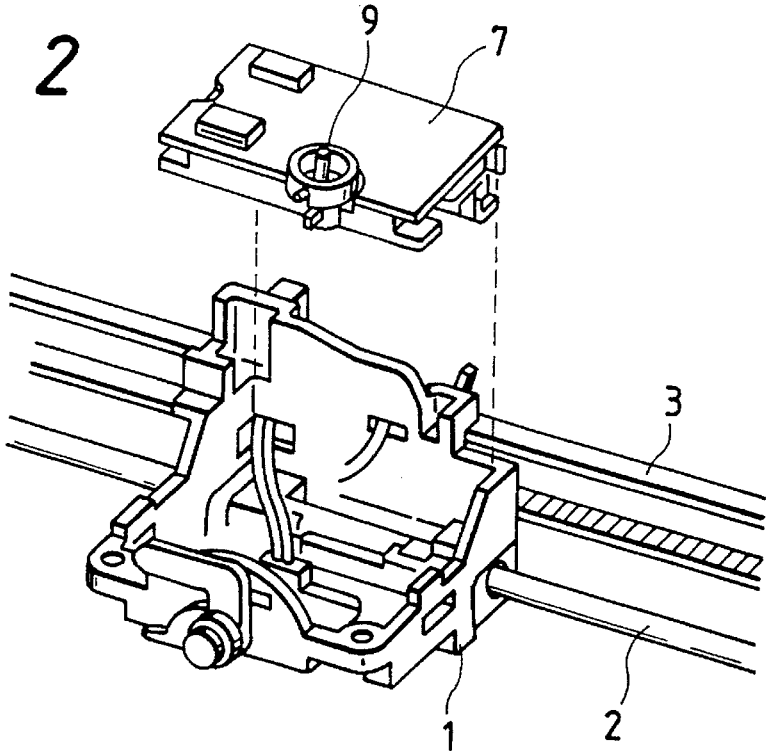
FIG. 2 is an enlarged view of an ink jet recording head mounted on a carriage in the ink jet recording apparatus.
Figure 3:
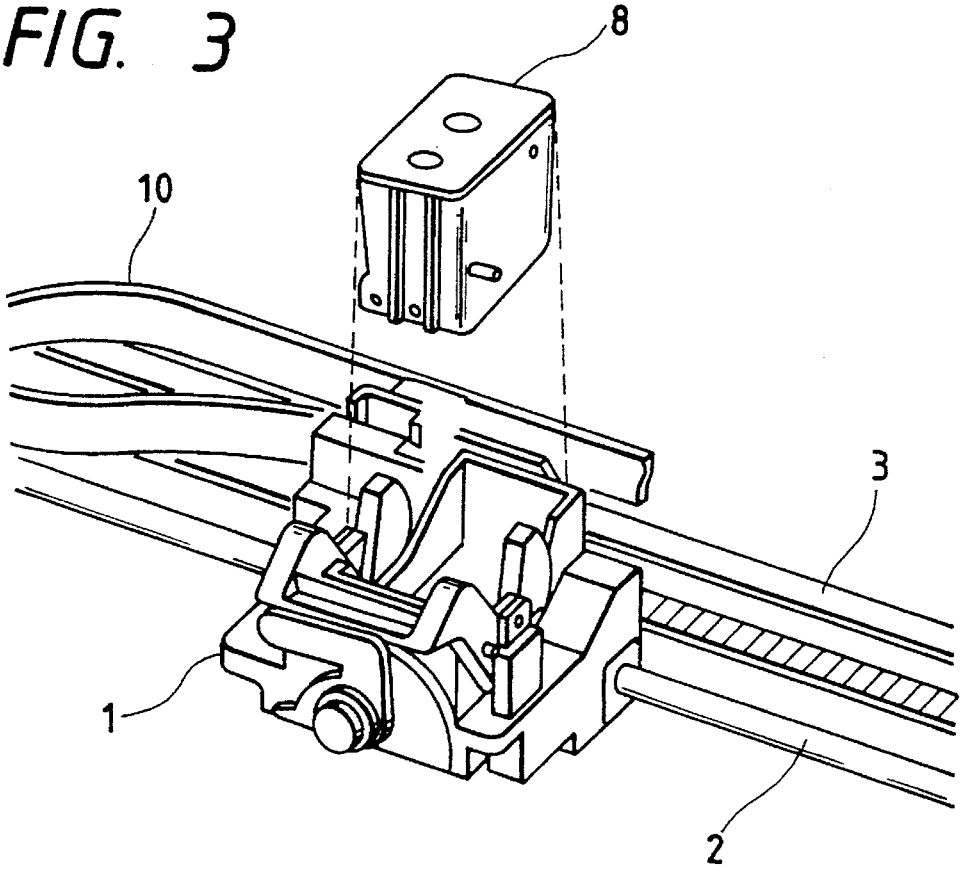
FIG. 3 is an enlarged view of an ink tank mounted on the carriage in the ink jet recording apparatus.

A recording head 7 is mounted on the carriage 1 in such a manner that nozzle openings are directed to printing paper 6, as shown in FIG. 2. An ink cartridge 8 is detachably mounted on the top of the recording head 7, as shown in FIG. 3. A base forming the recording head 7 is provided with an ink needle 9 (as described below) by which an ink supply passage of the recording head and the ink cartridge 8 are connected.

According to this structure, when a drive signal from a head drive circuit (not shown) is received via a flexible cable 10, ink flows into the recording head from the ink cartridge and dots can be formed on the recording paper connectively.

Figure 4:
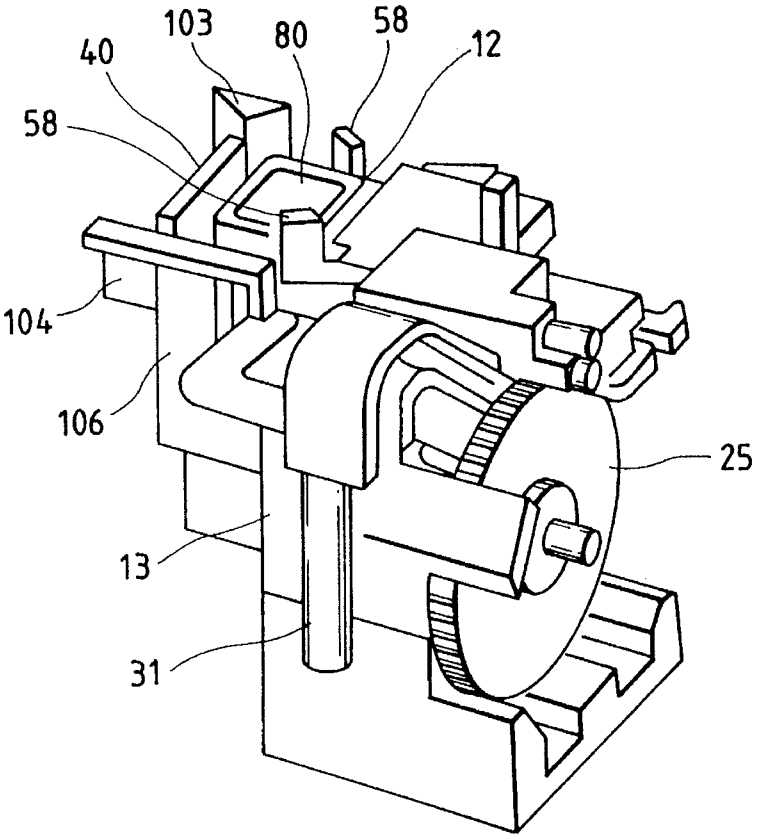
FIG. 4 is an enlarged view of a pump unit and a capping unit in the ink jet recording apparatus.

Referring again to FIG. 1, a capping unit 12 and a suction pump unit 13 (described below) are located outside the print area of the carriage 1. The capping unit 12 is integral with the suction pump unit 13 for convenience of assembly and maintenance, as shown in FIG. 4.

Figure 5:
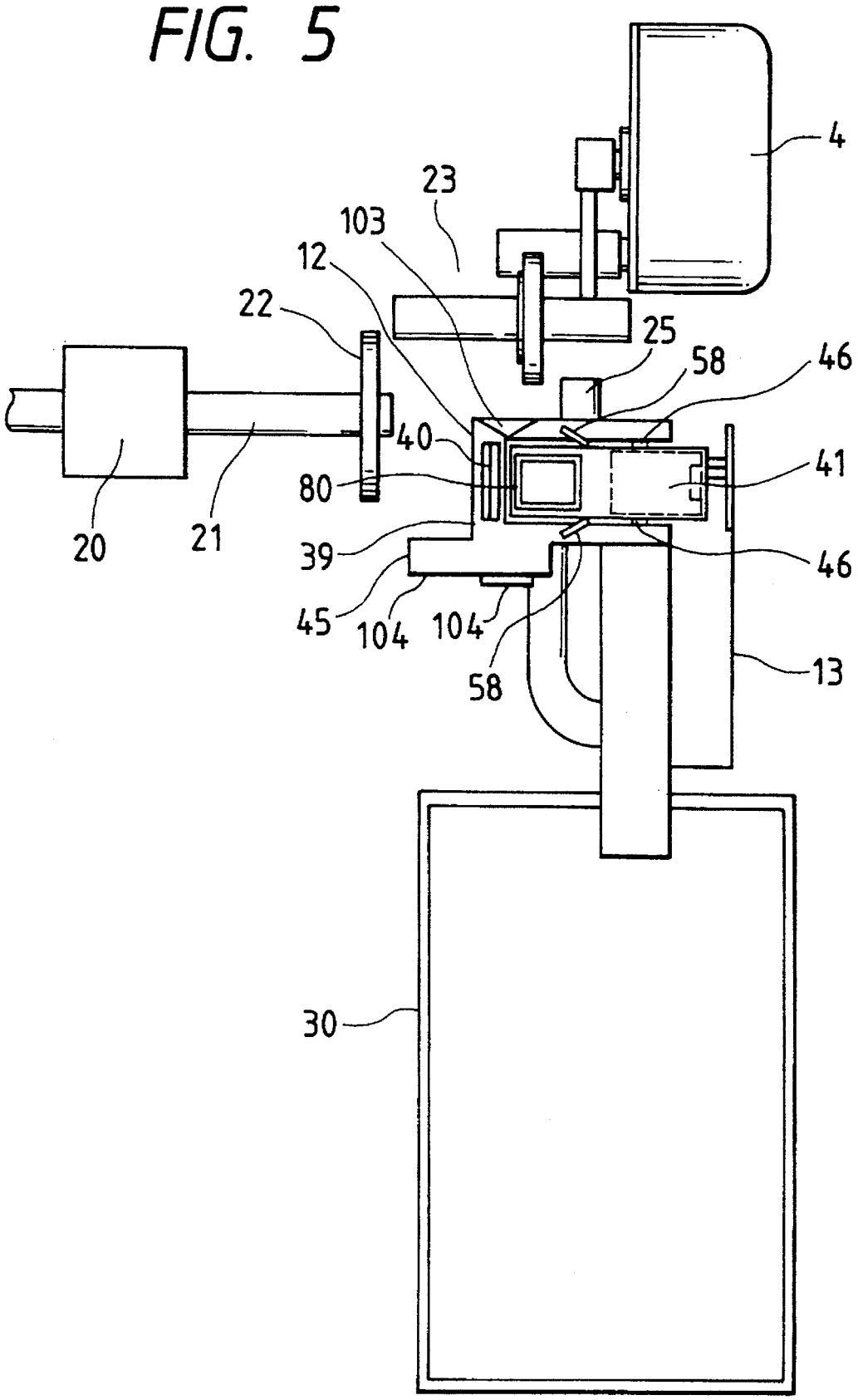
FIG. 5 is a top view showing the location relationship between the pump unit and the capping unit in the ink jet recording apparatus.
Figure 6:
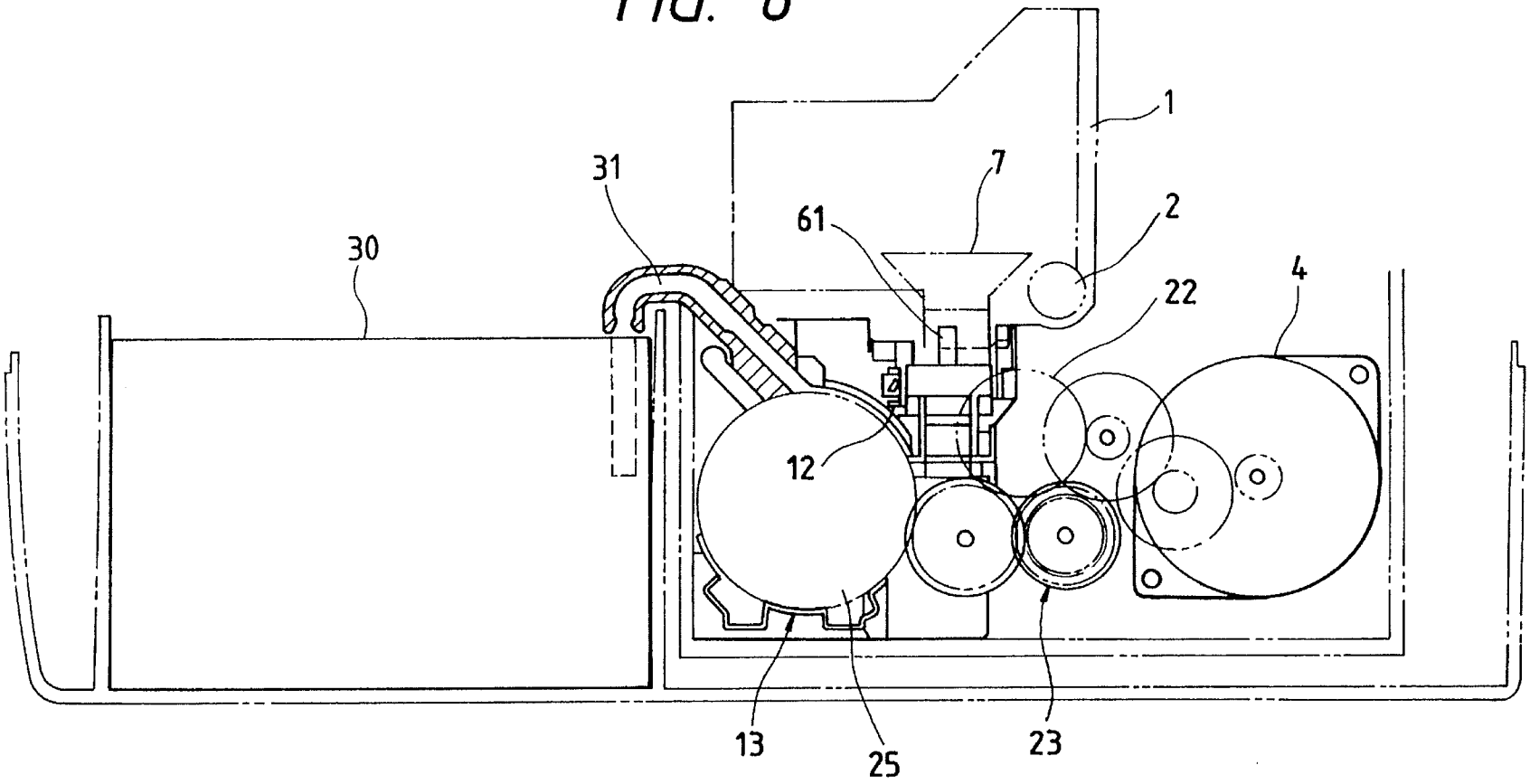
FIG. 6 is a side view showing the relationship between the pump unit and a pulse motor for paper feed for driving the pump unit in the ink jet recording apparatus.

FIGS. 5 and 6 are views showing the top and section around the capping unit, wherein reference numeral 20 indicates a paper feed roller, with a gear 22 secured to one end of a rotation shaft 21, which is connected to or disconnected from a pulse motor 4 for paper feed via a wheel train 23 which also serves as a connection switch mechanism. That is, when the wheel train 23 moves in the leftward direction in FIG. 5, the wheel train 23 meshes with the gear 22, enabling supply of recording paper, and when the wheel train 23 moves in the rightward direction in FIG. 5, the wheel train 23 meshes with a driving gear 25 (FIG. 4) of the suction pump unit 13, generating negative pressure.

Figure 7:
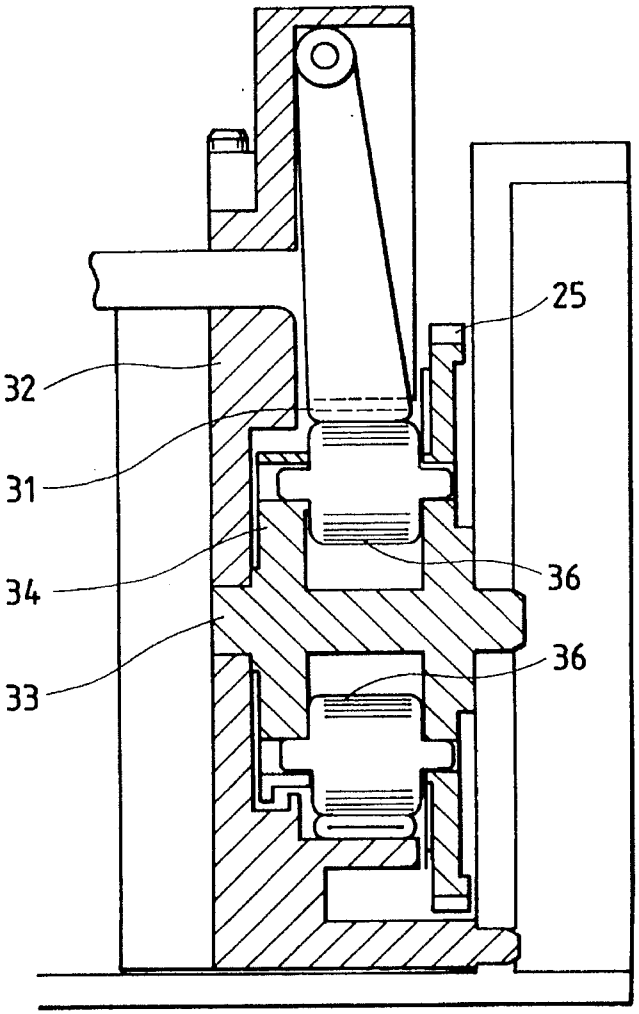
FIG. 7 is a sectional view showing one embodiment of the pump united used with the invention.

FIG. 7 shows an embodiment of the pump unit 13. It is formed as a so-called peristaltic pump in which the outside of a pump tube 31 connected a cap member 80 and a waste ink tank 30 is held by a cover case 32 so as to make it substantially like a circle and the inner peripheral surface thereof is pressed by two rollers 36, 36 pivotally secured to a drive board 34 driven by a rotation shaft 33. The rollers 36, 36 are loosely engaged with a long groove (not shown) with the distance from the center gradually changing to the drive board 34, and are secured so that when the pulse motor 4 for paper feed rotates forward, the rollers 36, 36 move to the side of the cover case 32 and pivot while pressing against the tube 31 and so that when the pulse motor 4 rotates reversely for paper feed, the rollers move in the center direction for departing from the tube 31.

Referring again to FIGS. 5 and 6, reference numeral 12 indicates the above-mentioned capping unit, is located outside the print area of the passage of the carriage and which includes a cap member 80 formed like a cup with elastic material so that it occupies a capping position covering the nozzle opening face of the recording head 7 and a non-capping position departing from the nozzle opening face in association with the movement of the recording head 7 (as described below), and a valve mechanism 41 for opening and closing communication with an atmospheric opening 64. These are installed on a slider 49 that can move parallel to the direction of motion of the carriage 1 and can move up and down.

Figure 8:
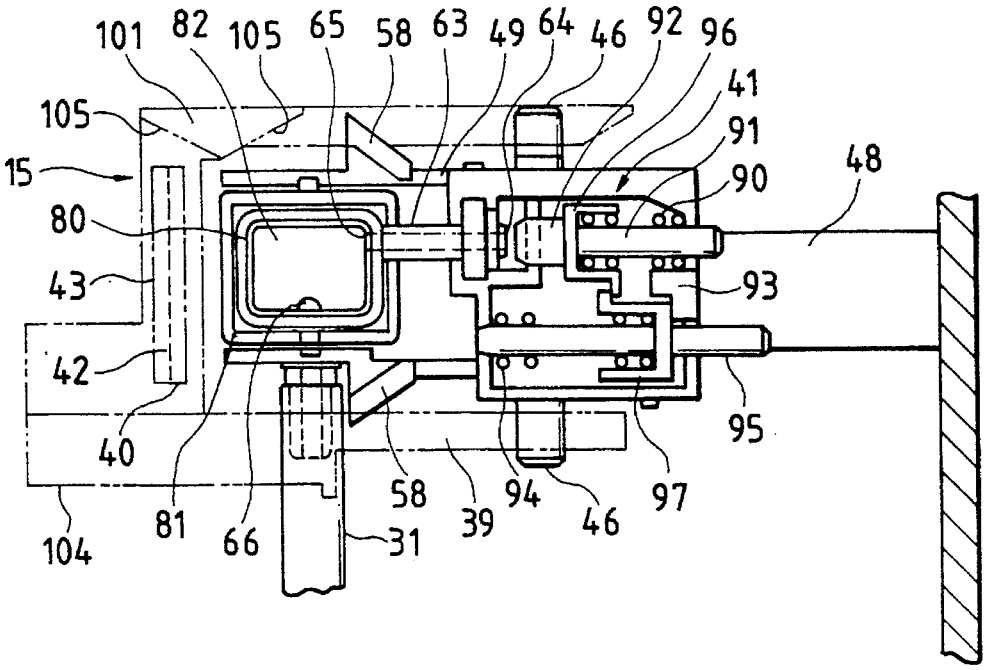
FIGS. 8(A) and 8(B) are a pair of drawings centering on the capping unit, FIG. 8(A) showing a state in which the recording head exists in a print area and FIG. 8(B) showing a state in which the recording head exists at a standby position.
Figure 8:
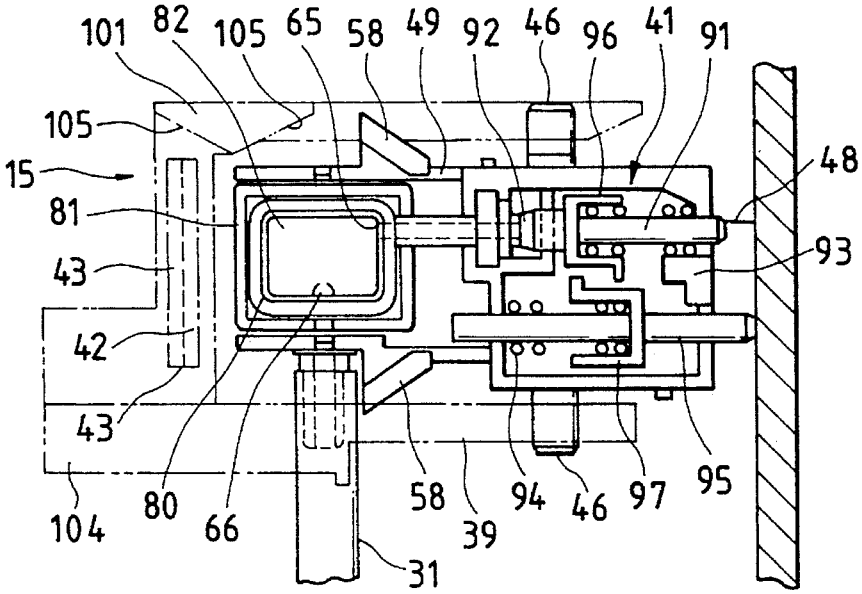
Figure 9A:
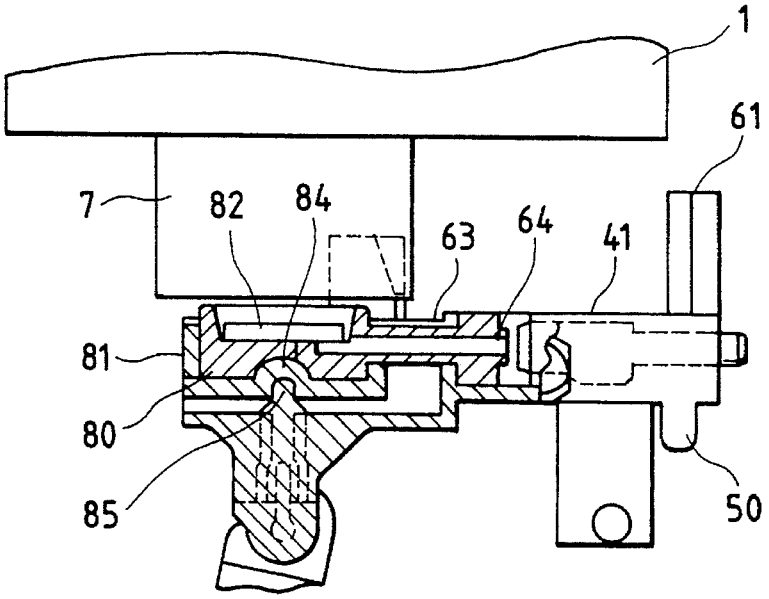
FIGS. 9(A) and 9(B) are a pair of drawings showing an embodiment of a cap member which is a component of the capping unit, FIG. 9(A) showing the section parallel to a move passage of the recording head and FIG. 9(B) showing the section perpendicular to the passage of the recording head.
Figure 9B:
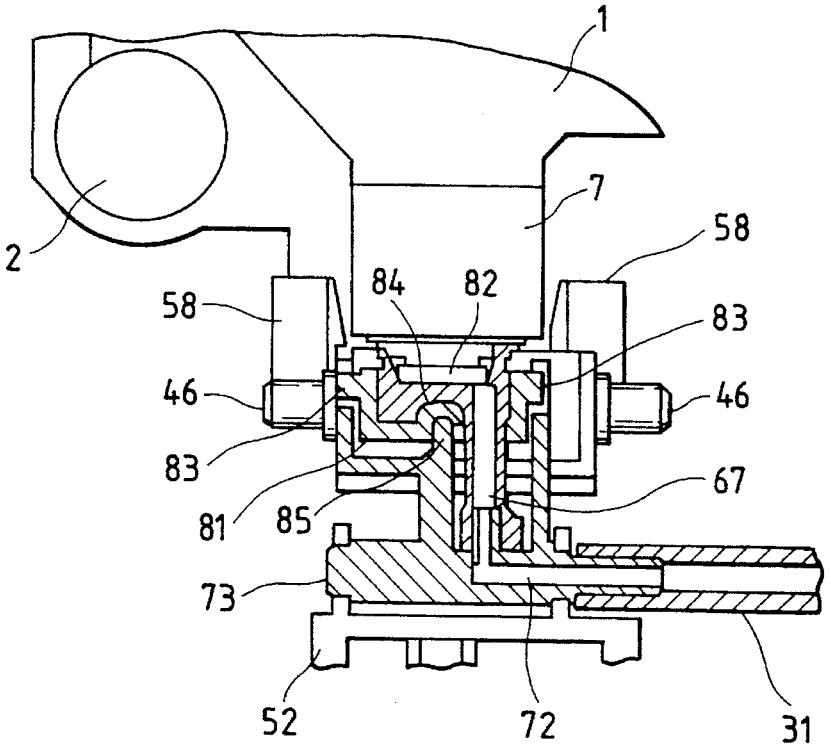

FIGS. 8(A) and 8(B) and 9(A) and 9(B) are drawings centering on the capping unit 12, FIGS. 8(A) and 9(A) show the state in which the carriage 1 is in the print area, and FIGS. 8(B) and 9(B) the state in which the carriage 1 is at the home position.

Reference numeral 49 depicts the above-mentioned slider. A projection 50 formed on the bottom moves with a base 48 as a slide face. The print area side is attached to a link 52 disposed on the base 48 and is energized in the upward direction and the print area direction by a spring 54 placed between the base 48 and the slider 49. The face on which the projection 50 of the slider 49 slides is composed of a slope 55 with the print area side down and a plane 56 at the height for pressing the cap member 80 against the recording head 7 when the recording head arrives at the home position. The slider 49 has guides 58 which widen and open in the print area direction side, conforming to the width of the recording head 7 on both sides, and a lock piece 61 engaged with a flag piece 60 of the carriage 1 in the external end portion.

The cap member 80 is formed as an elastic cup having an air inlet 65 communicated with the atmospheric opening 64 via a pipe 60 on the top and an intake 66 at which negative pressure from the pump unit 13 works. Ducts 63, 67 connecting the air inlet 65 and the atmospheric opening 64 and the intake 66 and the pump tube 31 are formed by injection molding so that they become integral with the elastic cup. The atmospheric opening 64 is opened and closed by the valve mechanism 41. A tube defining the duct 67 is connected to the pump tube 31 via a connection hole 72 pierced in the slider 49.

As shown in FIGS. 9(A) and 9(B), the cap member 80 is housed in a reception member 81 made of high-rigid material such as macromolecular material so that the opening margin portion of the cap member exposes, and contains an ink absorber 82 made of a porous substance for absorbing ink. The reception member 81 has two shafts 83 extending in the direction perpendicular to the direction of movement of the recording head 7 on the top and is formed with a hemispheric recess 84 on the bottom; the top is loosely supported by the slider 49 by the two shafts 83 (FIG. 9(B)), and the bottom is loosely supported by a hemispheric projection 85 projecting from the slider 49 for airtightly pressing the cap member 80 into contact with the nozzle opening face of the recording head 7 independently of the attitude of the recording head 7.

Referring again to FIGS. 8(A) and 8(B), the valve mechanism 41 comprises a valve body 92 opposed to the atmospheric opening 64 and secured to one end of a guide stick 91 always energized to the atmospheric opening 64 by a spring 90, a driving stick 95 energized outwardly by a spring 94 stronger than the spring 90 so that the opposite side to the print area always projects from a frame 93, and lock pieces 96 and 97 for engaging the guide rod 91 and the driving stick 95. Thus, when the driving rod 95 is pushed into the state shown in FIG. 8(B) as the recording head 7 moves, the valve body 92 loses the suppression force of the driving stick 95 and abuts against the atmospheric opening 64 by energy of the spring 90 for disconnecting communication of the cap member 80 with the atmosphere.

Reference numeral 15 indicates the cleaning unit in which a cleaning member 40, which is composed of laminated layers of a rubber plate 42 appropriate for a wiping operation on the outside and a sponge material 43 appropriate for rubbing operation on the print area side, is fixed to a frame 39 swingably secured to shafts 46 disposed on both sides of the capping unit 12 for moving between the cleaning position and the non-cleaning position as the carriage 1 moves. The frame 39 is loosely supported on one face by a long groove 100, and on the other by a round hole (not shown) to the shafts 46 disposed on both sides of the slider 49 supporting the cap member 80 so that it can switch with the round hole side as the center in the upward direction and in the direction perpendicular to the move direction of the recording head 7. The frame 39 is formed with a projection 102 extending downward to the center of the print side tip and is always energized in the print area direction and downward by pull spring 103 placed between the frame 39 and the slider 49. The frame 39 is also formed with release pieces 101 (described below) on both sides between which the move passage of the recording head 7 is sandwiched on the top and is formed with a cam face 104 on the side.

The release piece 101 is formed as a triangular pole with the recording head passage side as the vertex, and when slopes 105, between which the vertex is sandwiched, contact the flag piece 60 of the carriage 1, is adapted to swing the frame 39 by angle θ in the horizontal direction with the shaft 46 as the center for releasing engagement of the cam face 104 and a cam follower 106 (described below).

Figure 10:
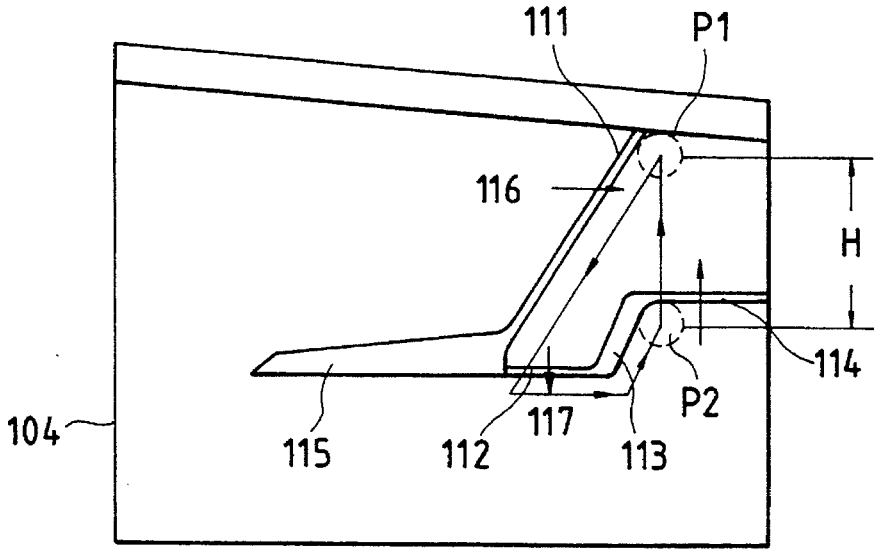
FIG. 10 is a drawing showing an embodiment of a cam face attached to a cleaning unit.

Referring to FIG. 10, the cam face has a first slope 111 defining a first passage for guiding the frame 39 upward when pushed in the direction outside the print area by the carriage 1 from stable point P1 contacting when the carriage 1 is in the non-abutting state, a second slope 112 defining a second passage horizontally extending in the direction outside the print area from the lower end of the first slope, a third slope 113 defining a third passage for raising the frame 39 to the cleaning position, a fourth slope 114 for holding the frame 39 at the cleaning position, and a fifth slope 115 for guiding the cam follower 106 to the first slope 111.

The section of each of the first slope 111 and second slope 112 is formed like a right angled triangle so that they can be overridden in moving in the directions indicated by arrows 116 and 117. The fourth slope 114 is selected as the height at which the cam follower 106 can override the slope when the frame 39 is swung. Step difference H is provided between stable point P1 and semistable point P2 so that the former point is placed at the position at which the cleaning member 40 does not abut against the nozzle opening face of the recording head 7 and so that the latter point is placed at the position at which the cleaning member 40 abuts against the nozzle opening face of the recording head 7.

Figure 11:
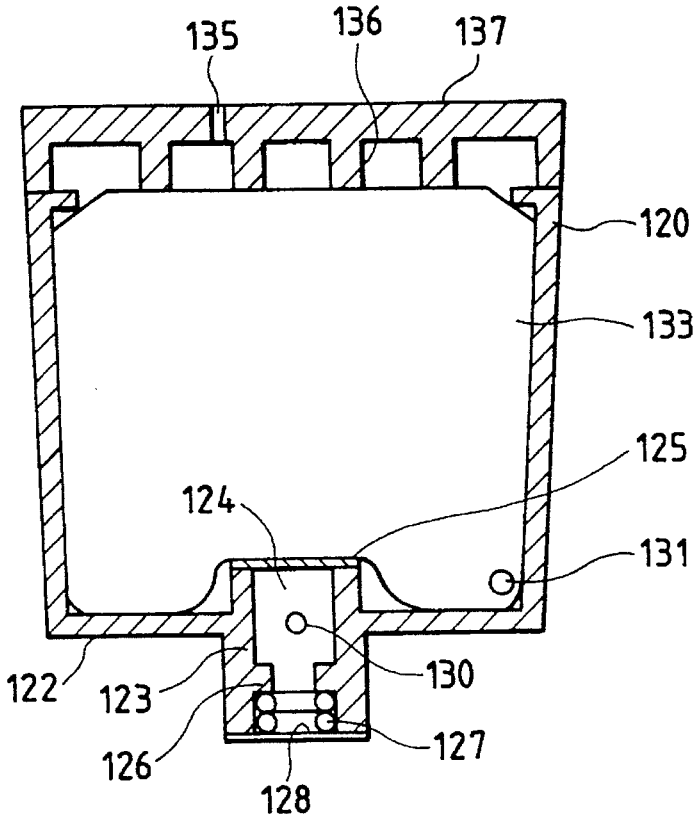
FIG. 11 is a sectional view showing an embodiment of an ink cartridge used with the ink jet recording apparatus.
Figure 12:
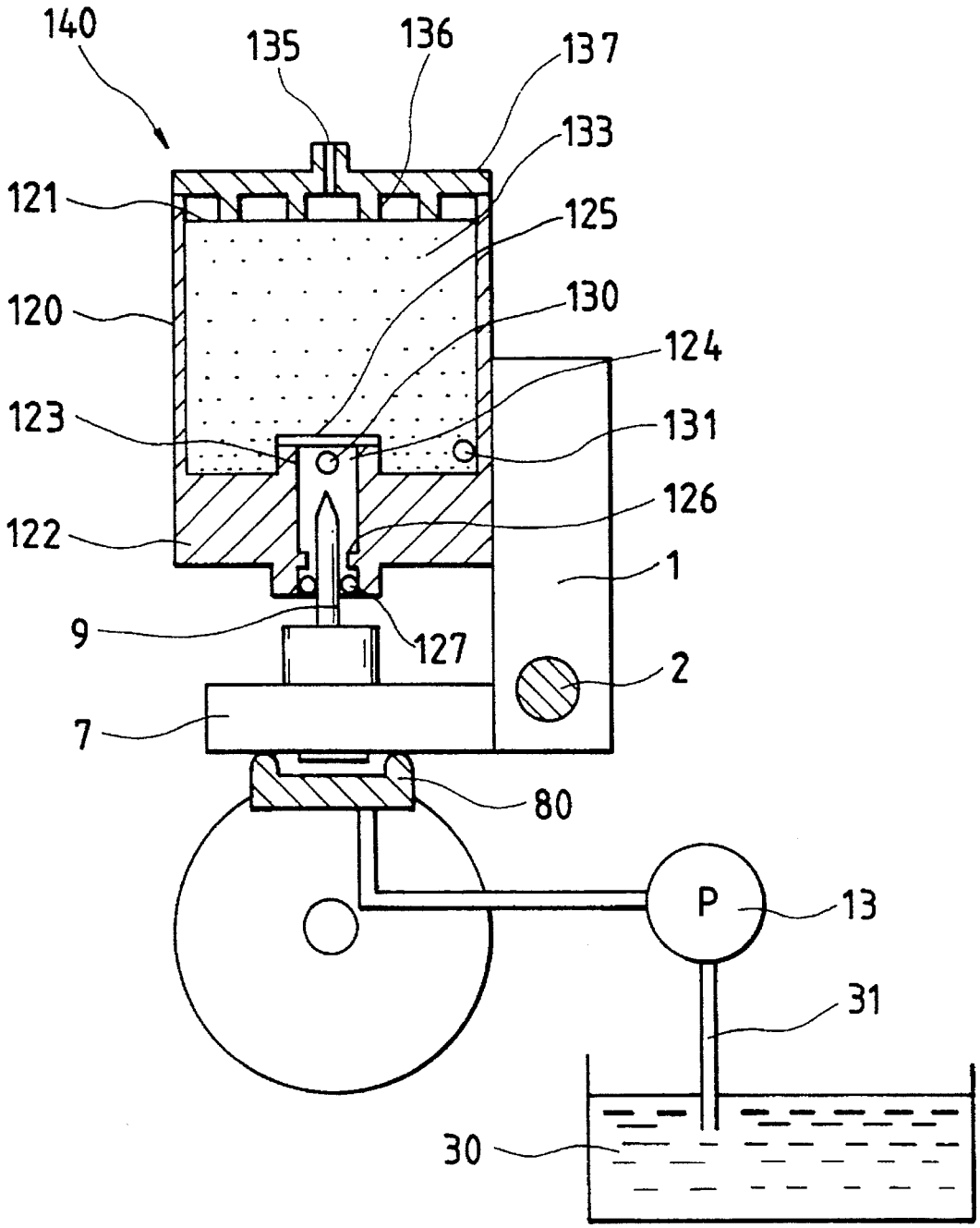
FIG. 12 is an illustration showing a state in which the ink cartridge in FIG. 11 is mounted on a cartridge.

FIG. 11 shows an ink cartridge appropriate for the ink jet recording system described above, wherein reference numeral 120 is a vessel forming the ink cartridge main unit. The vessel has an opening 121 on the top and is slightly tapered toward a bottom 122. An ink outlet 123 engaged elastically with and surrounding an ink supply needle 9 (FIG. 12) fixed to the recording head 7 is integral with the vessel 120 on the bottom 122.

The ink outlet 123 has one end formed like a pipe projecting from the bottom and an opening 124 to which a filter 125 is welded.

A step difference 126 is formed at the center of the inner face of the ink outlet 123. Packing material pressed against the ink supply needle 9 for maintaining the fluid-sealing state (in the embodiment, a rubber ring or so-called O ring 127) is housed on the tip opening side and a film 128 through which the ink supply needle easily passes is welded to the outer opening portion for sealing. Two electrodes 130 and 131 are disposed near the bottom of the vessel 120; one is located in the vessel and the other in the ink outlet 123.

Reference numeral 133 is a porous substance forming an ink absorber. The porous substance 133 has a section slightly larger than the opening 121 of the vessel 120 and is slightly higher than the vessel. The lower end portion of the porous substance 133 is pressed against the filter 125 of the ink outlet 123 for compression in response to the form of the ink outlet 123 and with its outer surface pressed by the side walls of the vessel 120, the porous substance is housed in the vessel 120 and is pressed against the bottom 122 by means of a cover 137 comprising an atmospheric communication port 135 and ribs 136 for sealing. Further, with the ink outlet 123 sealed, ink is poured from the atmospheric communication port 135 under a negative pressure of 0.5 psi or higher and absorbed into pores of the porous substance 133, thereby forming an ink cartridge.

Figure 13:
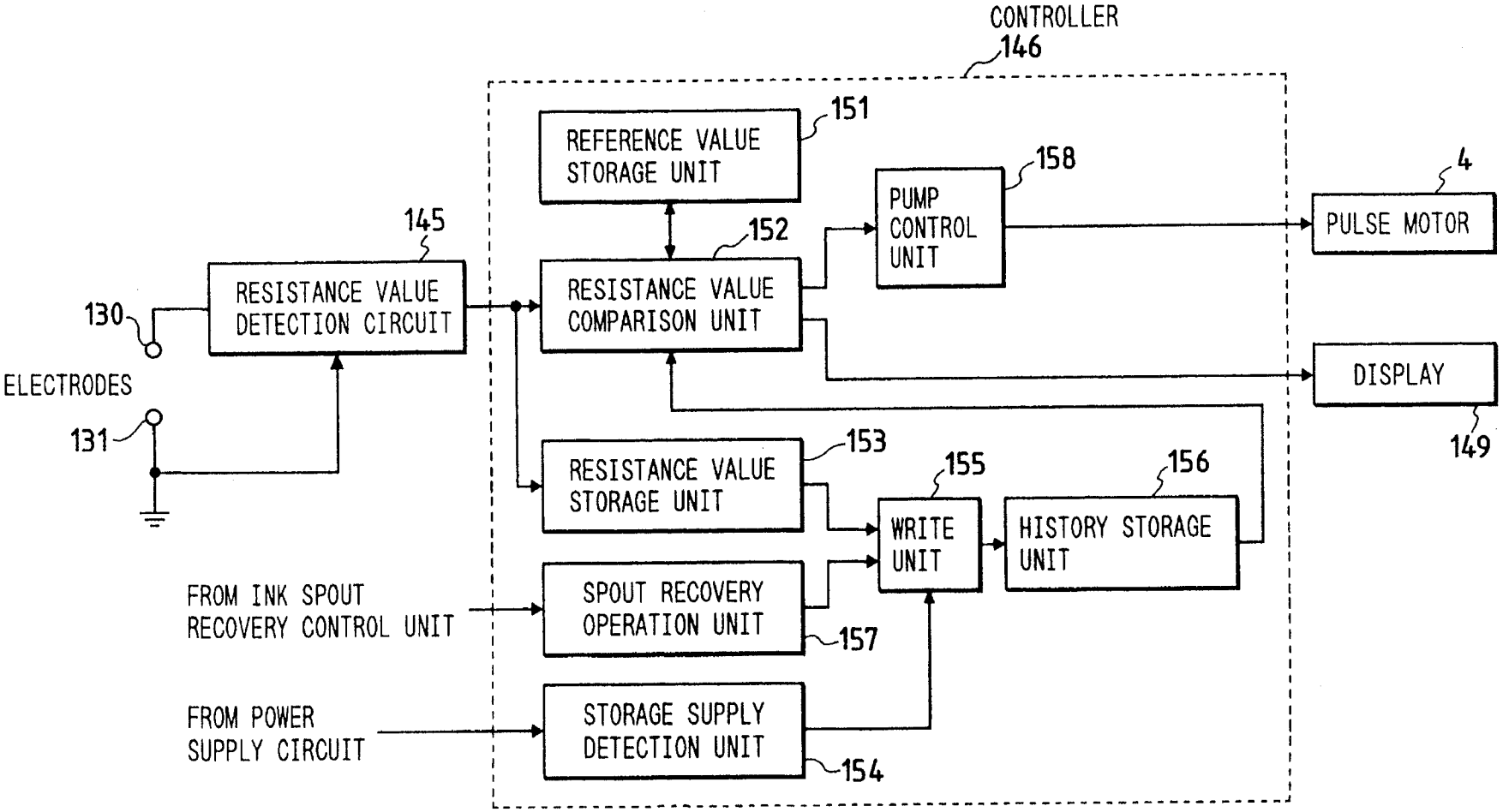
FIG. 13 is a block diagram showing one embodiment of a controller which controls ink handling in the ink jet recording apparatus.

FIG. 13 shows a controller which controls ink handling in the ink jet recording apparatus described above, wherein reference numeral 145 is a resistance value detection circuit for measuring electric resistance between the electrodes 130 and 131 disposed on the ink cartridge 140. The resistance value detection circuit 145 is adapted to apply an alternating voltage across the electrodes 130 and 131 at a given period, for example, every second, for measuring the resistance value.

Reference numeral 146 indicates a controller, which is a microcomputer programmed so as to provide resistance value comparison unit 152 for comparing a reference resistance value stored in reference value storage unit 151 (described below) with a resistance value from the resistance value detection circuit 145, resistance value storage unit 153 for updating the resistance value from the resistance value detection circuit 145 in sequence and storing it, supply voltage detection unit 154 for detecting the voltage of a power supply circuit driving the printing apparatus lowering to a given value for outputting a signal, write unit 155 responsive to the signal from the supply voltage detection unit 154 for transferring data in the resistance value storage unit 153 and data from ink spout recovery operation monitor unit 157 (described below) to history storage unit 156 composed of a nonvolatile memory, and pump control unit 158 for controlling the pulse motor 4 based on data from the resistance value comparison unit 152. When the cleaning process is executed, the ink spout recovery operation monitor unit 157 turns on a flag. When the cleaning process terminates normally as an operation sequence, the unit 157 turns off the flag. If the cleaning operation aborts due to, for example, power failure during the cleaning, the unit 157 outputs the flag as data.

Figure 18:
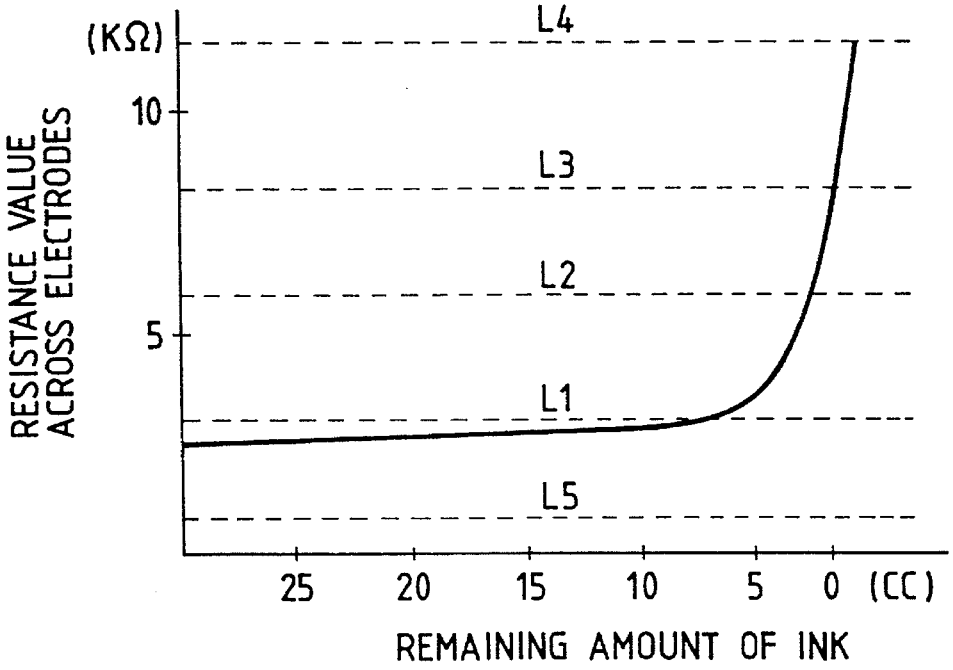
FIG. 18 is a chart showing the relationship between remaining amounts of ink in an ink cartridge and resistance across electrodes.

The reference value storage unit 151 stores a first reference $L_1$ indicating the lower limit of a resistance value when an appropriate amount of ink exists in the ink cartridge, a second reference $L_2$ indicating data of a resistance value at which the user is prompted to change the ink cartridge when the ink cartridge contains a small amount of remaining ink, a third reference $L_3$ indicating data of a high resistance value when the ink cartridge contains almost no remaining ink, a fourth reference $L_4$ indicating data of an extremely high resistance value when no ink cartridge is mounted, and a fifth reference $L_5$ indicating data of an extremely low resistance value to detect a different kind of ink, a short circuit of the electrodes, etc., as shown in FIG. 18.

The pump control unit 156 includes drive patterns for controlling the pulse motor 4 so as to enable suction modes in response to every situation, such as a small quantity of suction for pulling out ink during an initial filling ink, suction when the ink cartridge is replaced with a new one, suction to discharge ink collected in an exhaust passage of ink, a small quantity of suction for meniscus recovery operation, and processing for detaching the drive roller 36 from the tube 31 to terminate suction operation. Reference numeral 149 in FIG. 13 is a display for displaying a message, etc.

Next, the operation of the apparatus thus configured is described.

Before the printing apparatus is used, the initial filling mode is executed. The initial filling mode can be started, for example, by the user who turns on a power switch while holding an ink spout recovery command button on the printer cabinet. Before or after the initial filling mode is started, the ink cartridge 140 is mounted on the recording head 7. At this time, if the position of the ink outlet 123 of the ink cartridge 140 is adjusted to the position of the ink supply needle 9 of the recording head 7 and the ink cartridge 140 is pushed vertically, the ink supply needle 9 passes through the seal member 128 and arrives at the packing member 127, thereby connecting the ink cartridge via the packing member 127 to the tip of the ink supply needle 9 of the recording head in fluid-sealing relation.

Figure 19:
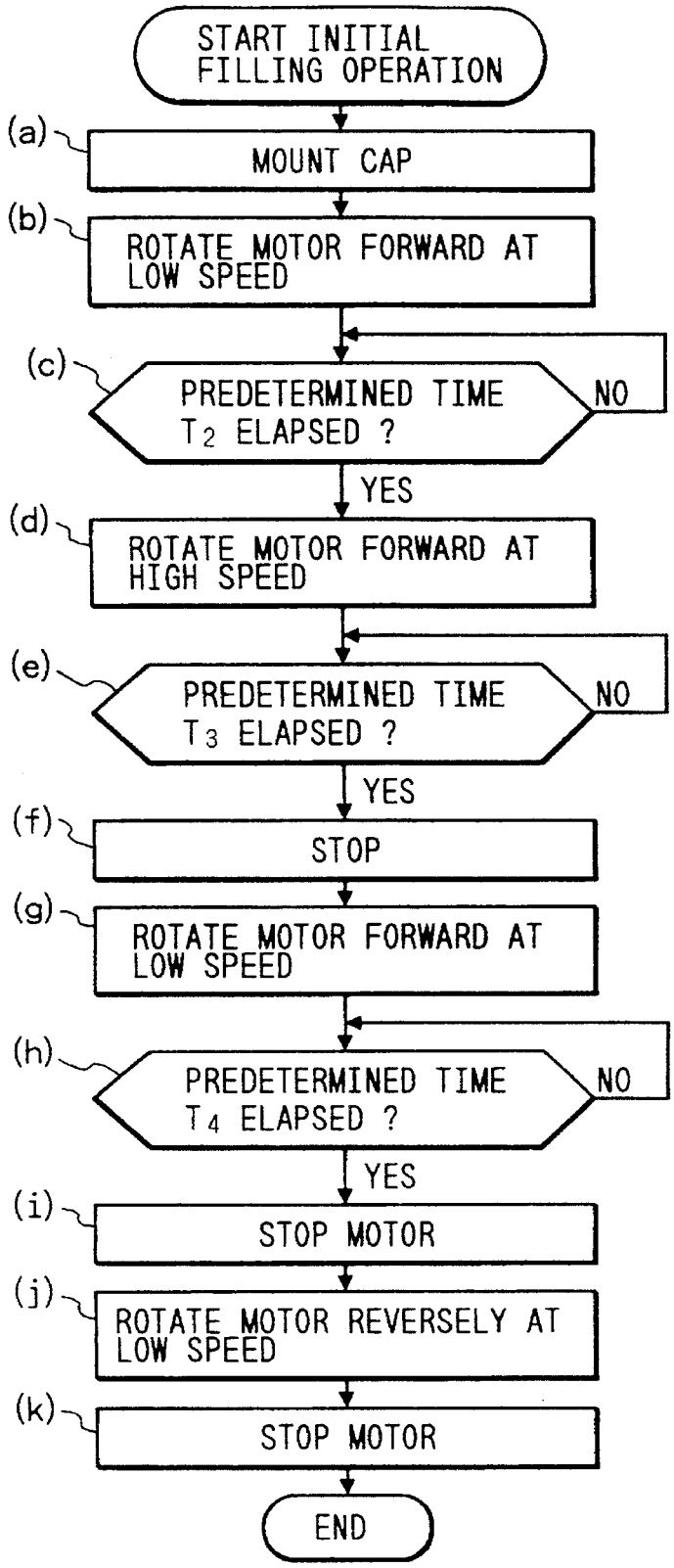
FIG. 19 is a flowchart showing initial filling operation of ink cartridge.

After this, when the cap unit 12 is mounted on the nozzle openings of the recording head 7 (step a in FIG. 19), the pump control unit 158 rotates the paper feed motor 4 forward at low speed (step b in FIG. 19), thereby transferring rotation force of the motor 4 via the wheel train 23 to the suction pump unit 13 for rotating the drive board 34, thereby causing the rollers 36 to move along the long groove to the outside and abut against the tube 31. The tube 31 is rubbed up by rotation of the motor 4 for generating weak negative pressure.

Then, weak negative pressure acts via the cap member 80 on the nozzle openings of the recording head 7, and thus ink in the ink cartridge 140 gradually flows into the recording head 7 at a low flow rate. By flowing the ink into the recording head 7 at the low flow rate, the ink flows into the recording head 7 without generating sediment in an uneven portion formed in the passage from the needle 9 to the nozzle openings of the recording head 7. This means that filling the recording head in the conventional manner using a transmitted liquid product for discharging air bubbles at factory shipment is not required, and that if the user tries performing initial filling of the recording head with ink, he or she can securely fill the recording head with ink.

After the ink flows into the nozzle openings by a small quantity of suction for a predetermined time T2 (step c in FIG. 19), the pump control unit 158 switches the pulse motor 4 to high speed rotation (step d in FIG. 19), thereby causing strong negative pressure to act on the nozzle openings. Ink of about 15 cc per minute, for example, is sucked out from the nozzle openings and therefore, air bubbles accumulating in the reservoir or pressure generation chamber of the recording head 7 at the initial filling with ink are discharged from the nozzle openings together with the ink flow.

When predetermined time T3 elapses and a given amount of ink, for example, about 2 cc, is sucked out (step e in FIG. 19), the pump control unit 158 stops the pulse motor 4 (step f in FIG. 19), thereby causing the inside of the cap member 80 to gradually rise to atmospheric pressure. When the cap member is restored to atmospheric pressure, the pump control unit 158 again rotates the pulse motor 4 forward at low speed (step g in FIG. 19) as described above. Then, weak negative pressure to the degree at which a very small amount of ink is spouted from the nozzle openings is generated in the cap member 80 and the meniscus of the nozzle openings disordered by high speed suction is restored to a state suitable for a printing operation. Very small air bubbles occurring at the high speed suction and air bubbles remaining in the sediment in the swirling state can be securely discharged by low speed suction. Performed, the low speed suction is preferred after the high speed suction is performed for the above-mentioned reason, but print operation can also be started immediately after the high speed suction.

When a time T4, enough for low speed suction, for example, two seconds, has elapsed (step h in FIG. 19), the pulse motor 4 is again stopped (step i in FIG. 19), and the inside of the cap member 80 is restored to atmospheric pressure, then the pulse motor 4 is rotated reversely at low speed a predetermined number of revolutions, namely, enough revolutions to move the rollers 36 abutting against the tube 31 in the center direction, thereby causing the drive rollers 36 to move on the long groove of the drive board 34 slowly in the center direction and leave the tube 31. If the pulse motor 4 stops after forward rotation, the drive rollers 36, 36 remain abutting against the tube 31. Thus, if the pulse motor 4 is subsequently rotated reversely, the pump unit 13 generates positive pressure for the cap member 80. During rotation at low speed, the generated pressure is extremely small and therefore before the pressure in the cap member 80 rises, the drive rollers 36 move on the long groove of the drive board 34 in the center direction and leave the tube 31. After this, the function of the pump is lost regardless of reverse rotation of the motor 4 (steps i, j).

As a result, the suction operation of the pump unit 13 can be terminated without destroying the meniscus formed at the nozzle openings of the recording head 7. The suction operation can be terminated in the state in which the meniscus appropriate for printing is held without applying unnecessary positive pressure to the cap member 80. By performing the operation sequence, the recording head and the ink passage filled with air at shipment are securely filled with ink to enable good printing.

Figure 20:
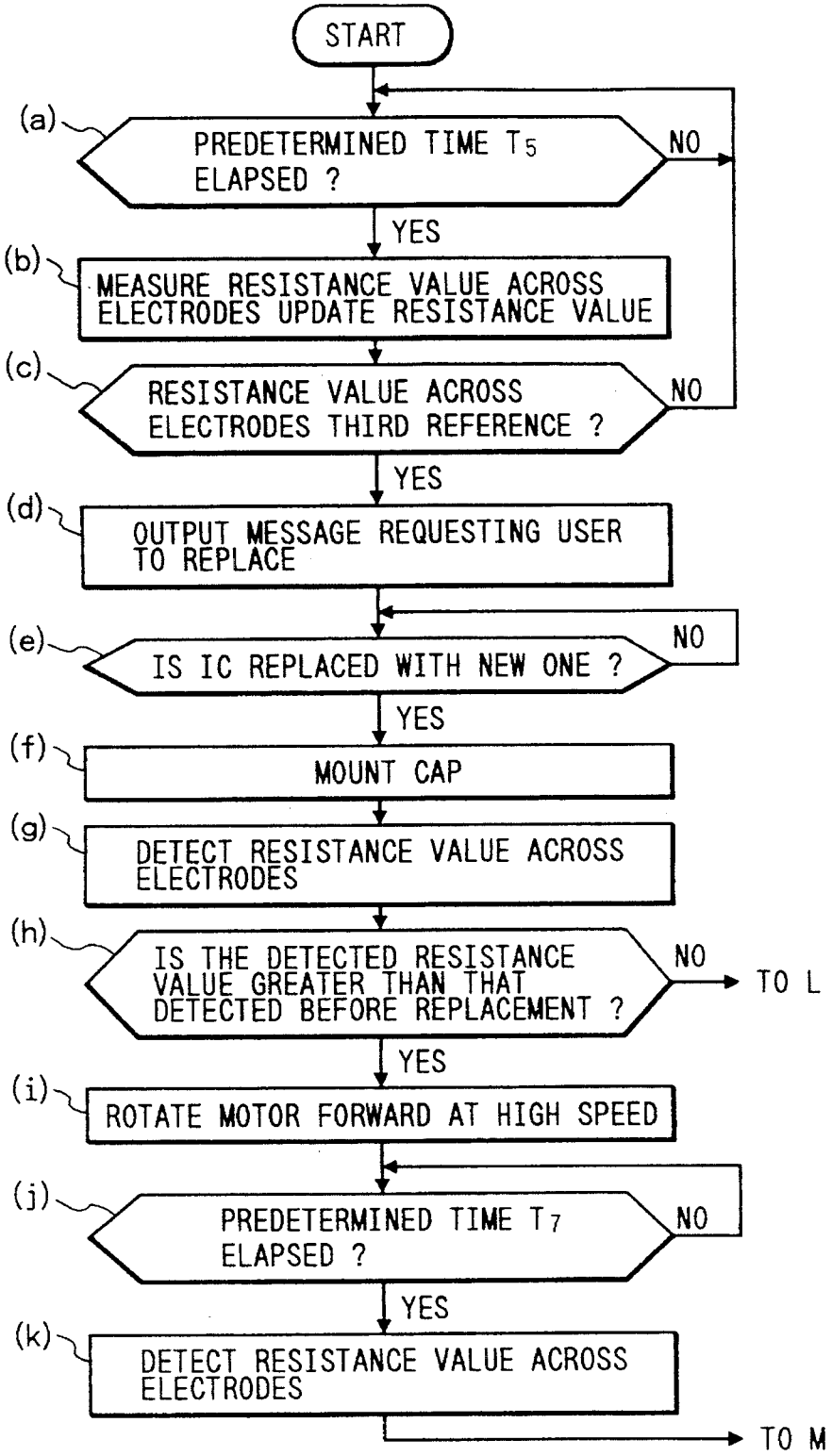
FIG. 20 is a flowchart showing operation when an ink cartridge is replaced with a new one.
Figure 20:
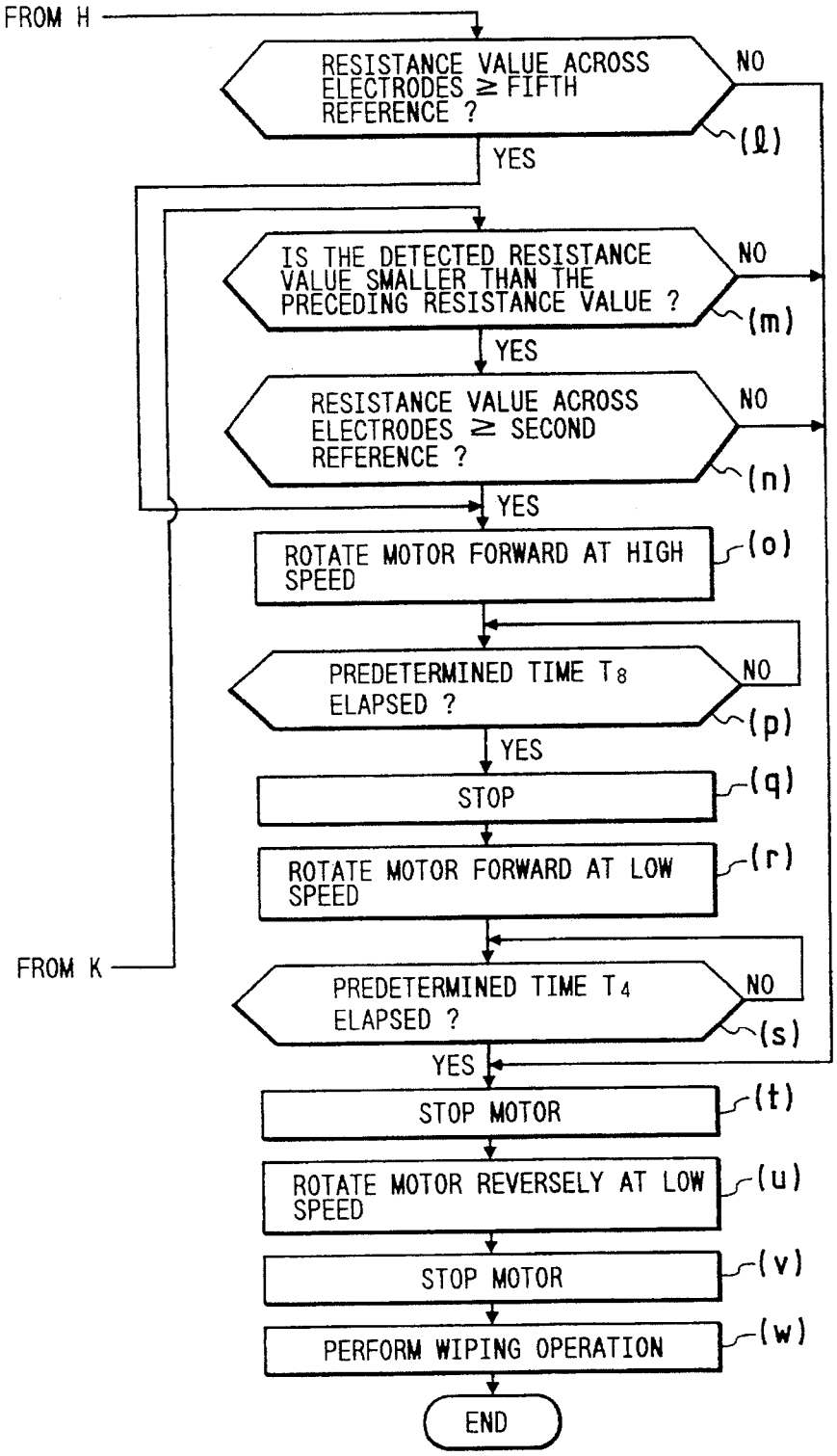

When the initial filling with ink ends and printing is performed, the resistance value detection circuit 145 detects the electric resistance value across the electrodes 130 and 131 at intervals of given time T5, for example, one second or during printing, every predetermined number of lines printed, for example, every line printed (step a in FIG. 20). The resistance value is stored while the contents of the resistance value storage unit 153 are updated in sequence (step b in FIG. 20), and is compared with data in the reference value storage unit 151 by the resistance value comparison unit 152 for monitoring the remaining amount of ink in the ink cartridge, etc., (step c in FIG. 20).

As shown in FIG. 18, if ink exists in the porous substance 133 to the degree at which it covers the filter 125 of the ink outlet 123, the resistance value across the electrodes 130 and 131 gradually increases as the ink is consumed, but maintains a low value (in the embodiment, about 2.4 kΩ). When the ink reaches depletion and the level drops below the filter 125, the resistance value increases sharply.

Thus, when the print amount increases and the ink amount in the ink cartridge 140 lowers, the resistance value across the electrodes exceeds the second reference $L_2$. Then, a message to the effect that the level of ink in the ink cartridge is low is displayed prompting the user to prepare a new ink cartridge. Even if the resistance value across the electrodes exceeds the second reference $L_2$, a small amount of ink remains for printing.

When further printing is performed and the resistance value across the electrodes exceeds the third reference $L_3$, a message is output requesting the user to replace the ink cartridge with a new one (step d in FIG. 20). If the user responds to the message by replacing the ink cartridge with a new one (step e in FIG. 20), the cap member of the cap unit is mounted on the recording head (step f in FIG. 20).

In this state, the resistance value across the electrodes is detected (step g in FIG. 20) and is compared with resistance value across the electrodes detected just before the ink cartridge is replaced. As a result of the comparison, if the resistance value across the electrodes detected after the ink cartridge is replaced is greater than that detected before the replacement (step h in FIG. 20), it is decided that there is a possibility that the user again has mounted the once drawn-out ink cartridge intact. That is, it is possible that the resistance across the electrodes increases because air bubbles entered the ink supply port when the ink cartridge 140 was drawn out and again mounted.

In this case, the pump control unit 158 rotates the pulse motor 4 forward at high speed (step i in FIG. 20), causing strong negative pressure to act on the nozzle openings for sucking out, for example, ink of about 15 cc per minute form the nozzle openings, thereby discharging air bubbles around the ink supply port occurring when the ink cartridge 140 was again mounted from the nozzle openings together with the ink flow. When a predetermined time T7, for example, one second has elapsed (step j in FIG. 20), the resistance across the electrodes is again measured for determining whether or not the measured resistance value is lower than the preceding value (step k in FIG. 20).

When a sufficient amount of ink remains in the ink cartridge, air bubbles which have entered are discharged by the sucked ink flow as described above, thus the resistance value across the electrodes lowers. In contrast, if no ink remains in the ink cartridge 140, air is drawn in between the electrodes by sucking out ink, increasing the resistance value across the electrodes (step m in FIG. 20). Thus, when the resistance value across the electrodes increases, if suction is continued, there is a chance that air will be drawn into the recording head. Then, the pump control unit 158 stops the pulse motor 4 for terminating the suction operation (step t in FIG. 20).

Although the suction causes the resistance value across the electrodes to drop, if the resistance value exceeds the second reference $L_2$ (step p in FIG. 20), the ink supply in the ink cartridge is nearly depleted and ink suction is stopped (step t in FIG. 20).

On the other hand, when the electrode resistance value just after the ink cartridge is mounted is lower than that detected before replacement, it can be determined that a new ink cartridge has been mounted. However, if the electrode resistance value of the ink cartridge after replacement is smaller than the fifth reference $L_5$ (step 1 in FIG. 20), it is possible that an error such as a short circuit across the electrodes of the ink cartridge is present. Thus, without performing the subsequent operation, control is transferred to the termination process of step w. If the suction operation causes the resistance value across the electrodes to drop, it can be determined that the ink cartridge contains a sufficient amount of ink. Therefore, the pump control unit 158 continues rotating the pulse motor 4 forward at high speed (step o in FIG. 20), causing a sufficient flow of ink from the ink cartridge 140 into the ink supply passage and the recording head, thereby securely discharging air bubbles.

When a predetermined time T8, for example, five seconds, has elapsed (step p in FIG. 20), the pump control unit 158 stops the suction operation (step q in FIG. 20), thereby causing the inside of the cap member 80 to gradually rise to atmospheric pressure. When it is restored to atmospheric pressure, the pump control unit 158 rotates the pulse motor 4 forward at low speed (step r in FIG. 20) as described above. Then, weak negative pressure sufficient to suppress a spout of ink from the nozzle openings is generated in the cap member 80, and the meniscus of the nozzle openings disordered by high speed suction is restored to the state suitable for print operation. Very small air bubbles occurring at the high speed suction and air bubbles remaining in the sediment in the swirling state can be securely discharged by low speed suction.

When a predetermined time T4 elapsed (step s in FIG. 20), the pulse motor 4 is stopped (step t in FIG. 20) and the inside of the cap member 80 is restored to atmospheric pressure. Then, the pulse motor 4 is rotated reversely at low speed a predetermined number of revolutions to move the rollers 36 abutting against the tube 31 in the center direction (step u in FIG. 20). The pulse motor 4 is stopped (step v in FIG. 20), thereby terminating the suction operation in the state in which the meniscus appropriate for printing is held without applying unnecessary positive pressure to the cap member 80. Then the wiping operation of the recording head is performed (step w in FIG. 20) to provide for the next print operation.

The wiping operation is described. When the recording head 7 is moved to the print area side, the slider 49 moves along the place 56 to the print area following movement of the carriage 1 by energy of the spring 54, as described above. When moving to a predetermined position, it arrives at the slope 55, and thus the slider 49 falls, thereby causing the cap member 80 to leave the front of the recording head 7. When engagement of the cap member 80 and the recording head 7 is completely released, the carriage 1 reverses the move direction and moves toward the outside of the print area, thereby causing the cam follower 106 to pass through the slopes 111, 112, and 113 and rise (FIG. 15 B). When it further moves and arrives at the semistable point P2, the frame 39 is lifted up by height H. As the frame 39 rises, the cleaning member 40 also rises and is set to a position at which it contacts the front of the recording head 7 (FIG. 16 A). In this state, if the carriage 1 is further moved toward the print area, a blade member 42 becomes the top side and abuts against the recording head 7, thus ink drops attached by suction are removed from the surrounding of the nozzle openings of the recording head 7.

Figure 14:
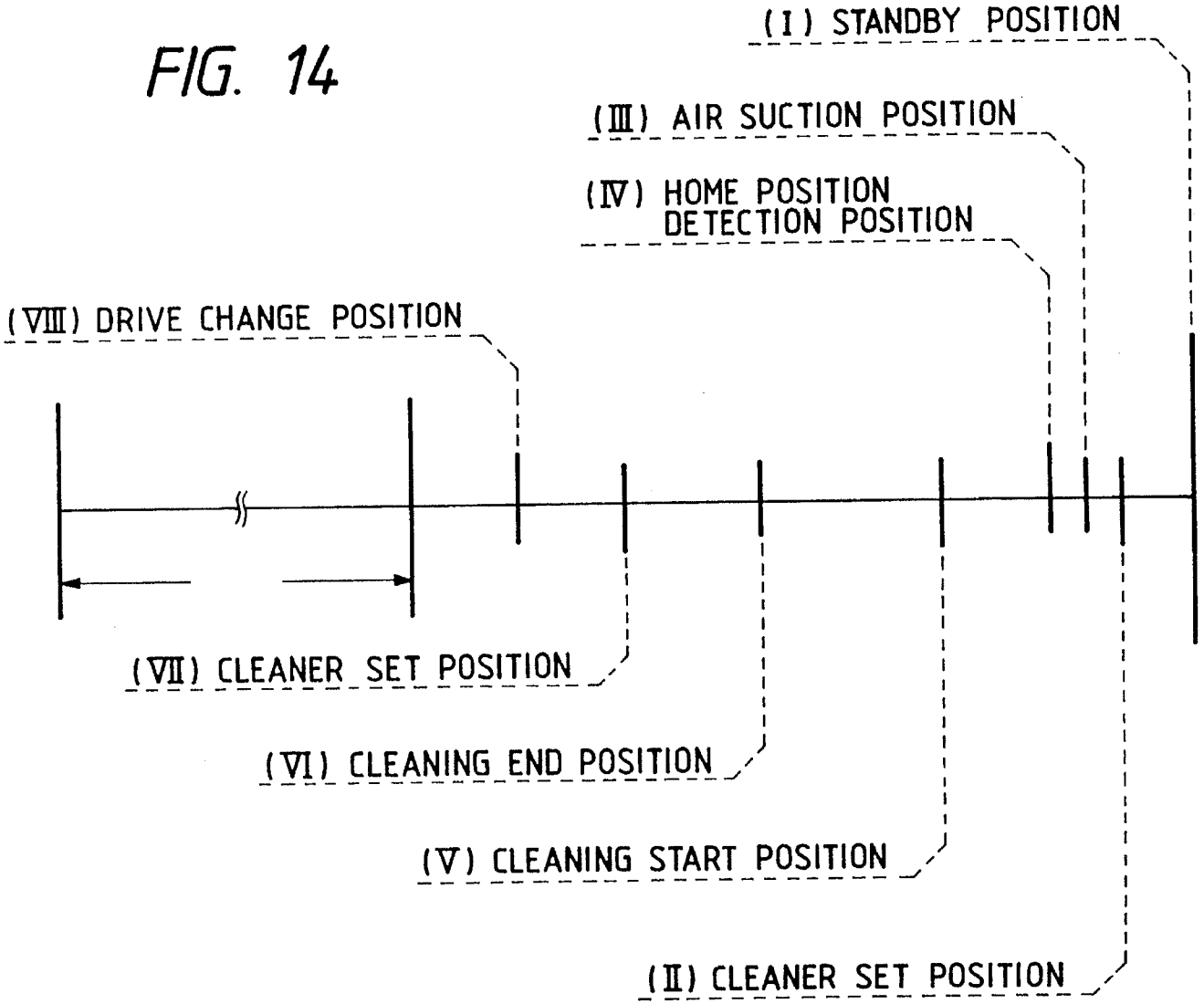
FIG. 14 is an illustration showing the relationship between carriage position and operation.
Figure 15A:
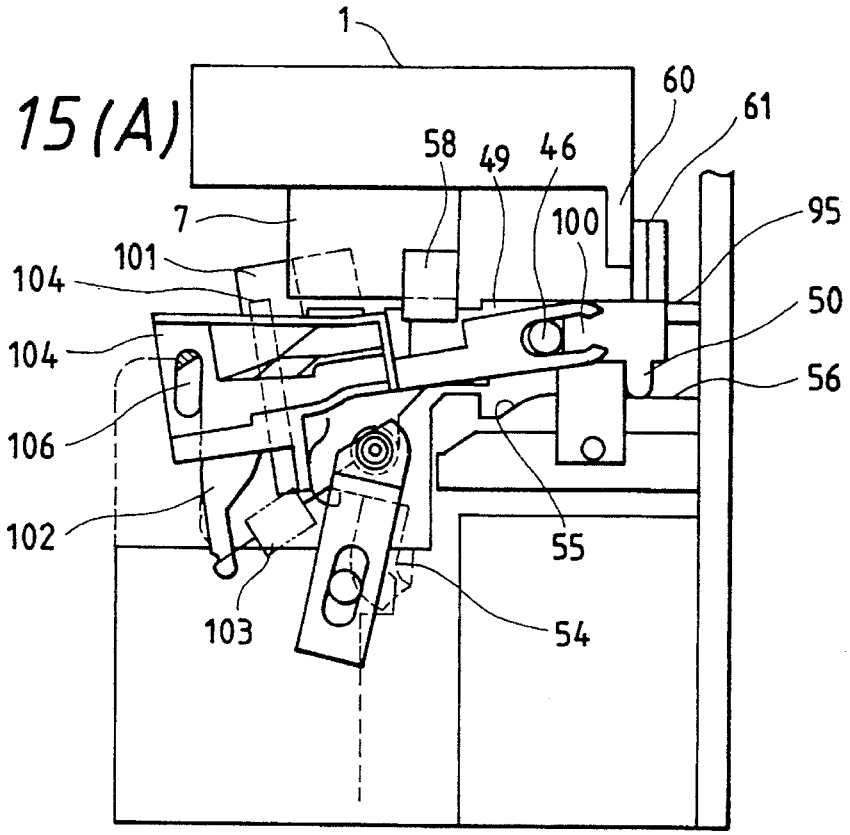
FIGS. 15(A) and 15(B) are illustrations showing capping unit motion and cleaning unit motion according to recording head positions.
Figure 15B:
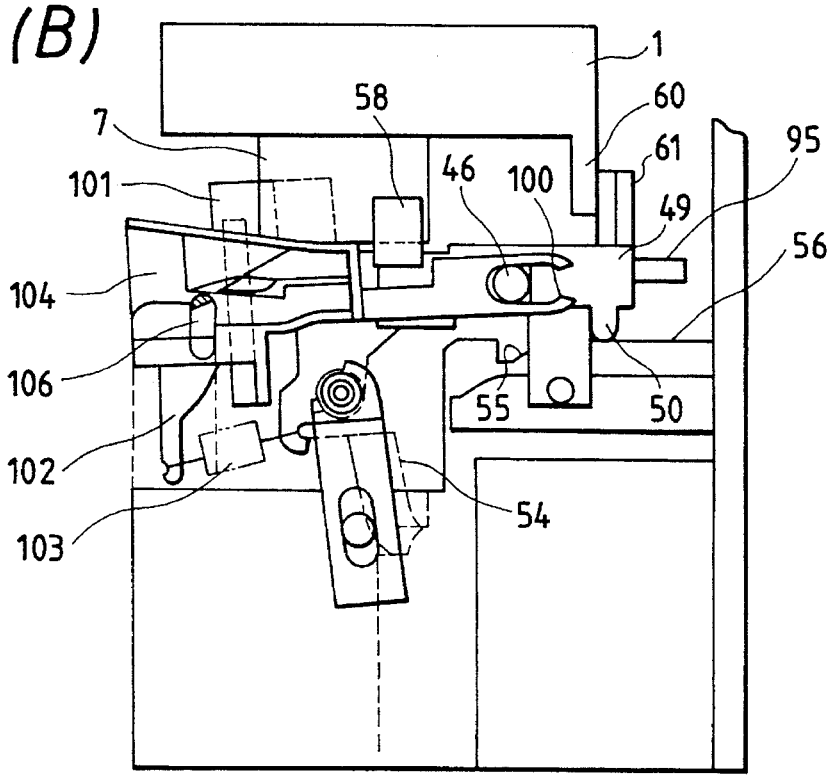
Figure 16A:
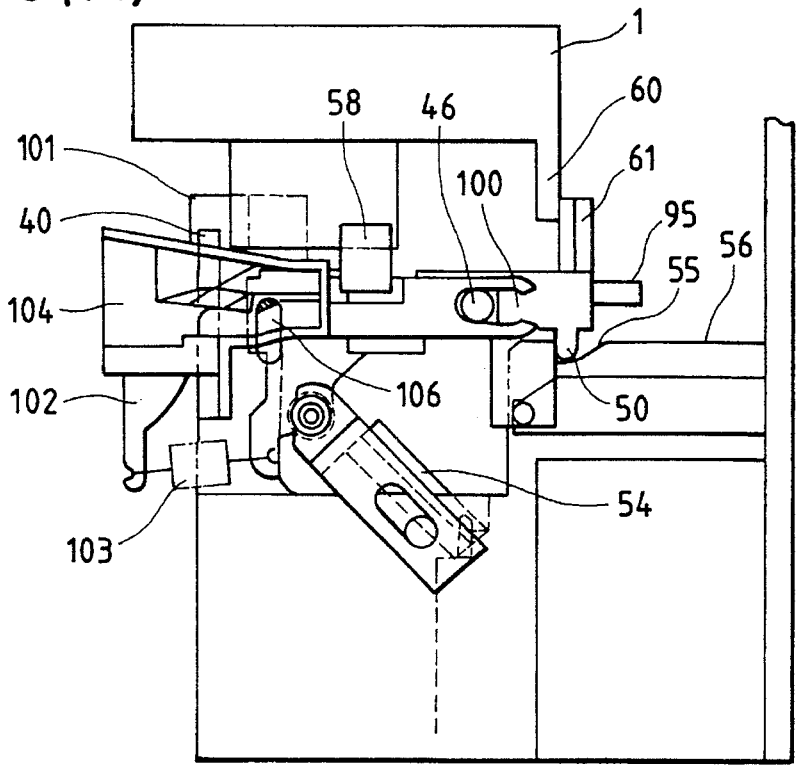
FIGS. 16(A) and 16(B) are illustrations showing capping unit operation and cleaning unit operation.
Figure 16B:
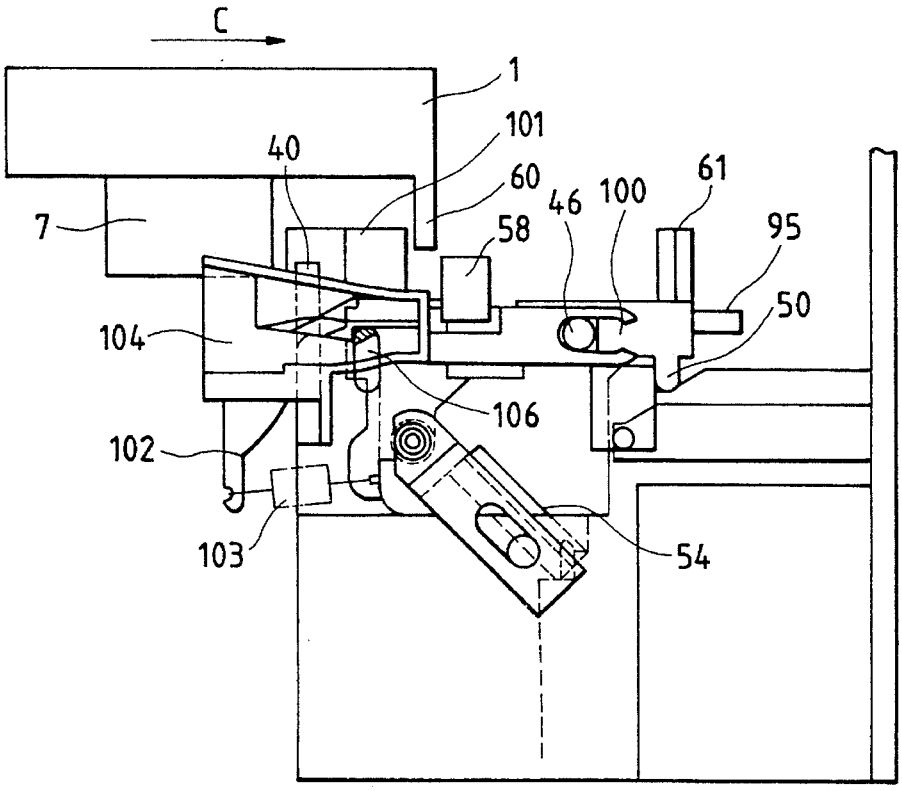

When the recording head 7 is at the home position (position I in FIG. 14), the frame 39 is lifted up with the cam follower 106 occupying the semistable position P2 on the cam face 104 and the atmospheric opening 64 is closed with the drive stick 95 of the valve 41 abutting against the base, and thus the recording head 7 is sealed by the cap member 80 for preventing ink from drying (FIG. 15(A)).

When the carriage 1 moves to the print area side, the recording head 7 is set to an air suction position (position III in FIG. 14) through a cleaner set position (position II in FIG. 14). During the move, the slider 49 moves on the place 56, and thus the cap member 80 continues to seal the front of the recording head 7. At this position, the value body 92 is removed from the atmospheric opening 64 by means of the drive stick 95. Thus, if the pulse motor 4 is rotated forward, negative pressure of the pump unit 13 acts on the cap member 80. However, since the atmospheric opening 64 is open, negative pressure does not act on the recording head 7 and only waste ink remaining in the absorber 82 and the tube 31 is sucked out and sent to the waste ink tank 30.

When the air suction thus terminates, if the carriage 1 is moved to the home position, the atmospheric opening 64 of the cap member 80 is blocked by means of the value mechanism 41 (FIG. 15(A)) (step b in FIG. 20). At the termination of filling with ink, the carriage 1 is moved toward the print area. The slider 49 moves along the place 56 to the print area following a move of the carriage 11 by energy of the springs 54 and 103. When moving to a predetermined position, it arrives at the slope 55, thus the slider 49 falls, thereby causing the cap member 80 to leave the front of the recording head 7. When engagement of the cap member 80 and the recording head 7 is completely released, the carriage 1 reverses its direction of movement, and moves toward the outside of the print area, thereby causing the cam follower 106 to pass through the slopes 111, 112, and 113 and rise (FIG. 15(B)). When it further moves and arrives at the semistable point P2, the frame 39 is lifted up by height H. As the frame 39 rises, the cleaning member 40 also rises and is set to a position at which it contacts the front of the recording head 7 (FIG. 16(A)). In this state, if the cartridge 1 is further moved toward the print area, a blade member 42 becomes the top side and abuts against the recording head 7. Thus, the area surrounding the nozzle openings of the recording head 7 is subjected to a wiping operation for removing ink drops spouted from the nozzle openings and attached to the nozzle opening face by suction for initial filling.

Figure 17:
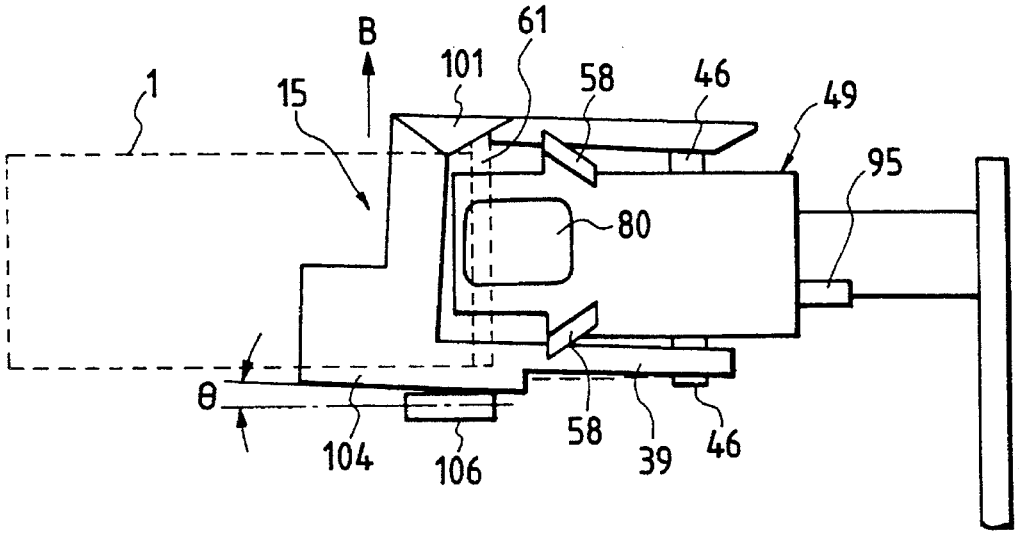
FIG. 17 is a drawing showing capping unit operation and cleaning unit operation.

When the recording head 7 passes through the cleaning member 40 and subsequently the false piece 60 of the carriage 1 arrives at the release piece 101, the release piece 101 is pushed away in the direction shown by arrow B in FIG. 17 by angle θ to the outside by the flange piece 60. Thus, the cam face 104 leaves the cam follower 106 (FIG. 17). Then, support of the slope 114 by the cam follower 106 is lost and the frame 39 is caused to fall by the energy of the spring 54 and the cleaning member 40 is evacuated to a location lower than the pass plane of the recording head 7. When the recording head 7 further moves to the print area side and passes through a drive switch position (position VIII in FIG. 14), the pulse motor 4 rotates reversely for feeding recording paper to the print area for enabling printing.

On the other hand, when print operation in the printing area continues for a predetermined time and a flushing operation is required, the print operation performed by the recording head 7 is temporarily stopped and the recording head 7 is moved toward the home position. While the recording head is moved toward the home position, the flag piece 60 of the carriage 1 passes through the release piece 101 and subsequently the recording head 7 arrives at the guides 58. The slider 49 is guided by the guides 58 to alignment with the center of the recording head 7. Further, the carriage 1 moves, the flange piece 60 abuts against the lock piece 61, and the recording head 7 is positioned at a flushing position (position V in FIG. 14) opposite the cap member 80 at a given gap length. In this state, the recording head 7 causes ink to be spouted out independently of a print signal from nozzle openings unused during the printing, thereby discharging ink in the nozzle openings not used during the printing into the cap member 80 to prevent ink in the nozzle openings from increasing in viscosity and to prevent the nozzle openings from drying.

On the other hand, for ink spout failure which is caused by air bubbles entering the pressure generation chamber of the recording head and which cannot be removed by performing only the flushing operation, the carriage 1 is moved to the home position and the cap member 80 is pressed into contact with the recording head 7. In this state, the pulse motor 4 is rotated at high speed, thereby spouting air bubbles, etc., present in the pressure generation chamber from the nozzle openings. As a result, ink consumption can be reduced as much as possible and the air bubbles in the recording head can be discharged.

In the printing process, the resistance across the electrodes is detected every predetermined time $T_5$, for example, every second or each time one line of printing is completed, as described above. The detected resistance values are transferred to the resistance value storage unit 153 in sequence for updating the resistance value data. When printing is completed and the power is turned off, a signal is output from the supply voltage detection unit 154. In response to the signal, the write unit 155 transfers the resistance value stored in the resistance value storage unit 153 to the history storage unit 156 for storage. A large-capacitance capacitor for smoothing is connected to the power supply circuit and the operation voltage can be maintained for the time required to transfer data for storage.

Figure 21:
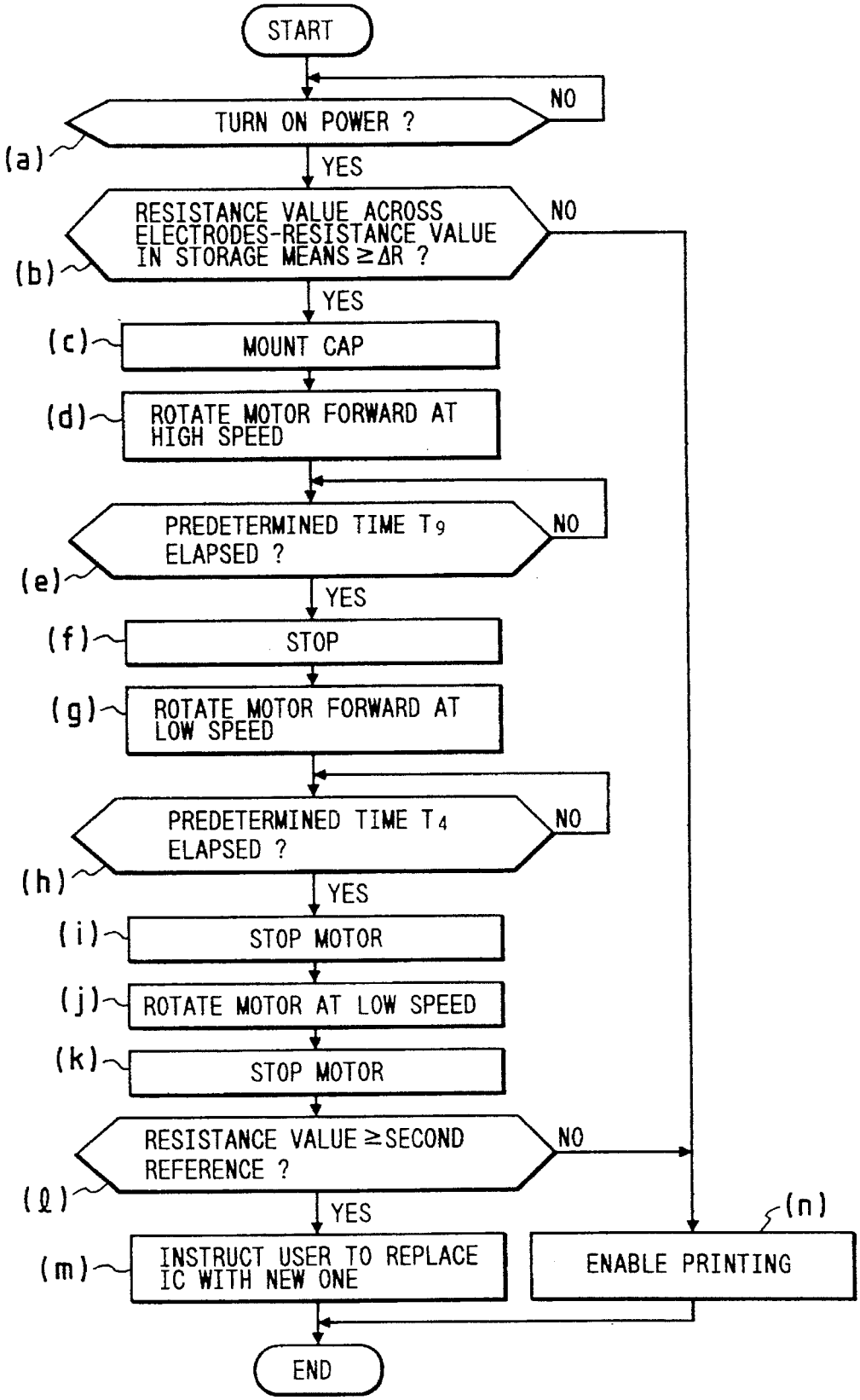
FIG. 21 is a flowchart showing a process which occurs just after the power is turned on with an ink cartridge mounted.

When the power is turned on (step a in FIG. 21), the resistance value comparison unit 152 compares the preceding resistance value across the electrodes stored in the resistance value storage unit 156 with the resistance value across the electrodes just after the power is turned on. If the difference between them, Δr, is greater than a predetermined value, namely, the resistance value change caused by temperature, etc., ΔR (step b in FIG. 21), the cap member 80 is pressed into contact with the recording head 7 (step c in FIG. 21). Then, the step motor 4 is rotated forward at high speed (step d in FIG. 21), thereby sucking out ink from the recording head 7 and discharging ink around the ink outlet 123 of the ink cartridge 140 via the recording head 7, thereby discharging air bubbles which entered by demounting or mounting the ink cartridge when the power was turned off. When the predetermined time $T_9$ has elapsed (step e in FIG. 21), the motor 4 is stopped (step f in FIG. 21), and is then rotated forward at low speed to return the meniscus to the state proper for printing and to discharge the air bubbles formed during high speed suction and the air bubbles remaining in the sediment (step g in FIG. 21), the motor 4 is stopped and the pressure in the cap member 80 changes from negative to atmospheric pressure (step I in FIG. 21). Next, the motor 4 is rotated reversely at low speed and the rollers 36 are separated from the tube 31 to provide for paper feed (steps j and k in FIG. 21). At this stage, the resistance value across the electrodes is compared with the second reference. If it is determined that the ink cartridge 140 contains sufficient ink (step 1 in FIG. 21), printing is enabled (step n in FIG. 21); if the ink cartridge contains less ink, a message is output instructing the user to replace the ink cartridge with a new one (step m in FIG. 21).

If the nozzle face of the recording head becomes dirty because of use for a long term, the wiping operation alone would be insufficient to remove dust and a rubbing operation is required. In this case, in a similar sequence to the wiping operation described above, the cleaning member 40 is raised and the printing head 7 is moved to the print area side. Then, the carriage 1 is moved in the direction opposite to the wiping operation (arrow C direction in FIG. 16B). Subsequently, with the rubbing member 43 on the top, the cleaning member 40 contacts the nozzle opening face of the recording head 7 for rubbing the nozzle opening face.

When the operation sequence thus terminates with no print data and the transition to the stop state is made, the carriage 1 is moved toward the standby position, thereby causing the slider 49 to climb up the slope 55 as the recording head 7 moves. When it further moves toward the outside of the print area, passage of the recording head 7 is detected by the home position detection unit (not shown) in the process.

When a signal is output from the home position detection unit and the carriage 1 is moved toward the outside of the print area for a predetermined distance, namely, for a deceleration distance required to stop the carriage 1 from a predetermined speed, the projection 50 of the slider 49 arrives at the plane 56 and the cap member 80 is pressed into contact with the front of the recording head 7. The carriage 1 passes through the air suction position (position III in FIG. 14) and the cleaner set position (position II in FIG. 14), then is placed at the standby position (position I in FIG. 14). In this state, the atmospheric opening 64 is sealed by means of the valve body 92; thus the recording head 7 can provide for the next print operation in a state in which ink in the nozzle openings can be prevented from drying.

Although in this embodiment data from the resistance value detection circuit 145 is stored in the RAM and then stored in the history storage unit as the supply voltage drops, it is clear that a similar effect can also be produced by directly storing the data in the nonvolatile storage unit for a given period.

In the above embodiment, when suction terminates, the pulse motor for paper feed is rotated at low speed and the rollers 36 are separated from the tube 31 without causing positive pressure to act on the recording head 7. However, if the cap member 80 is detached from the recording head 7 when the cap member is returned to positive pressure after suction terminates, the meniscus will not be destroyed even if the pulse motor is rotated reversely at high speed.

Further, when a sequence of ink spout recovery operation steps including the suction operation is started, the ink spout recovery operation monitor unit 157 turns on the flag, and when the ink recovery operation sequence terminates, turns off the flag. However, if the power is turned off in error while the ink spout recovery operation is being performed, the operation voltage drops, which is detected by the supply voltage detection unit 154 and the flag is stored in the history storage unit 156 by the write unit 155. When the power is again turned on, the data in the history storage unit 156 is read out, and if the read data contains data indicating that the ink spout recovery operation flag is on, the ink spout recovery operation is performed before print operation is started. Thus, even if the meniscus of the recording head 7 is destroyed because of the incomplete ink spout recovery operation, the ink spout recovery operation is again executed, thereby forming the normal meniscus for printing in the optimum state.

As described above, in the invention, the ink jet recording apparatus comprises a recording head communicated via an ink supply member with an ink tank comprising electrodes for detecting a remaining amount of ink and being responsive to a print signal for spouting ink drops from nozzle openings onto recording paper, capping means abutting against the front of the recording head for holding the nozzle openings in an airtight state, suction means for supplying negative pressure to the capping unit and sucking out ink in the capping unit into a waste ink tank, resistance value detection means for detecting electric resistance across the electrodes for detecting a remaining amount of ink, reference value storage means for storing a resistance value across the electrodes relative to the remaining amount of ink in the ink tank as a reference value, resistance value comparison means for comparing the resistance across the electrodes with the reference value, and pump control means responsive to the resistance value comparison result for controlling the operation of the suction means. Therefore, the ink amount and the state of the ink tank can be determined precisely for automatically selecting the ink suction mode in response to the state, enabling the user to execute initial filling which is otherwise comparatively hard to perform. In addition, air bubbles entering the ink tank due to improper handling of the ink tank such as during remounting can also be detected for proper automatic processing by ink suction.

What is claimed is:

1. An ink jet recording apparatus, comprising:

means for producing a print signal, a recording head in communication with an ink tank through an ink supply member, said ink tank comprising electrodes for detecting a remaining amount of ink, said recording head being responsive to a print signal for spouting ink drops from nozzle openings to recording paper, capping means abutting against a front of said recording head for holding the nozzle openings in an airtight state, suction means for supplying negative pressure to said capping means and sucking out ink from said capping means into a waste ink tank, resistance value detection means for detecting electric resistance across the electrodes for detecting a remaining amount of ink, reference value storage means for storing a resistance value across the electrodes relative to the remaining amount of ink in the ink tank as a reference value, resistance value comparison means for comparing the resistance across the electrodes with the reference value and computing a resistance value comparison result, and suction control means responsive to the resistance value comparison result for controlling operations of said suction means.

2. The ink jet recording apparatus as claimed in claim 1, wherein said suction control means comprises an ink tank replacement mode in which, when an ink tank is replaced, a resistance across the electrodes detected just before the ink tank is replaced is compared with that detected after the ink tank is replaced, and the suction of the ink from said capping means is executed if the latter resistance is smaller than the former.

3. The ink jet recording apparatus as claimed in claim 2, wherein said suction means executes suction at a high flow rate and subsequently at a low flow rate.

4. The ink jet recording apparatus as claimed in claim 3, wherein said high flow rate is executed for a predetermined time.

5. The ink jet recording apparatus as claimed in claim 3, wherein said low flow rate is executed after the pressure in said capping means is substantially restored to atmospheric pressure.

6. The ink jet recording apparatus as claimed in claim 5, wherein said low flow rate is executed for a predetermined time.

7. The ink jet recording apparatus as claimed in claim 2, wherein said suction is executed only if the latter resistance exceeds a threshold resistance.

8. The ink jet recording apparatus as claimed in claim 1, wherein said suction control means comprises an ink tank replacement mode in which, when the ink tank is replaced, said suction control means compares a resistance across the electrodes just before replacement of the ink tank with a resistance value after the replacement, and if the former is smaller than the latter, executes suction at a high flow rate by said suction means while detecting a change in the resistance across the electrodes, and if the resistance across the electrodes drops as the suction is executed, continues the suction at the high speed for a predetermined time.

9. The ink jet recording apparatus as claimed in claim 8, wherein, in said ink tank replacement mode, after the suction at the high speed is continued for said predetermined time, subsequent suction at low rate is executed.

10. The ink jet recording apparatus as claimed in any one of claim 8 or 9, wherein if the resistance value across the electrodes does not drop when the suction is executed at the high speed, the suction operation is stopped.

11. The ink jet recording apparatus as claimed in claim 1, further comprising history storage means for storing at least resistance across the electrodes at power off in a nonvolatile manner and comparison means for comparing said resistance stored in said history storage means and a resistance value across the electrodes when power is turned on and instructing an ink suction operation to be executed if the resistance value across the electrodes when power is turned on is higher than the resistance value stored in said history storage means.

12. The ink jet recording apparatus as claimed in claim 1, wherein when an ink tank is first mounted, suction at a low flow rate is first executed, and subsequently suction at a high flow rate is executed.

13. The ink jet recording apparatus as claimed in claim 1, wherein suction in a high flow rate is first executed, and subsequently suction at a low flow rate is executed in a sequence of ink spout recovery operation steps including the suction operation.

14. The ink jet recording apparatus as claimed in claim 1, wherein said reference value storage means stores at least a reference indicating that the ink tank contains sufficient ink, another reference for instructing a user to replace the ink tank with a new one, and a further reference for detecting a state in which no ink tank is mounted.

15. An ink jet recording apparatus, comprising:

a recording head in communication with an ink tank through an ink supply member, said recording head being responsive to a print signal for spouting ink drops from nozzle openings to a recording paper, capping means abutting against a front of said recording head for holding the nozzle openings in an airtight state, suction means for supplying negative pressure to said capping means and sucking ink from said capping means into a waste ink tank, said suction means being formed as a peristaltic pump comprising an elastic tube and a plurality of rollers, wherein said rollers press against said tube to create a suction when a motor for feeding said recording paper rotates in one direction, and said rollers are released from said tube to thereby discontinue said suction when said motor rotates in another direction, and wherein after the suction terminates, the rotation in said another direction is executed at a lower speed than the rotation in said one direction, and suction control means responsive to a remaining amount of ink in said ink tank for controlling operations of said suction means.

16. An ink jet recording apparatus, comprising:

a recording head in communication with an ink tank through an ink supply member, said recording head being responsive to a print signal for spouting ink drops from nozzle openings to recording paper, capping means abutting against a front of said recording head for holding the nozzle openings in an airtight state, suction means for supplying negative pressure to said capping means and sucking ink in said capping means into a waste ink tank, and storage means for storing an ink spout recover operation termination flag indicating whether or not a sequence of ink spout recovery operation steps containing the suction operation has terminated, wherein, when power is turned on, data indicating the ink spout recovery operation termination flag is read out, and if said data indicates that said ink spout recovery operation steps have not terminated, the ink spout recovery operation is again executed.

17. An ink jet recording apparatus, comprising:

a recording head in communication with an ink tank through an ink supply member, said ink tank comprising electrodes for detecting a remaining amount of ink, said recording head being responsive to a print signal for spouting ink drops from nozzle openings to recording paper, capping means abutting against a front of said recording head for holding the nozzle openings in an airtight state, suction means for supplying negative pressure to said capping means and sucking out ink in said capping means into a waste ink tank, resistance value detection means for detecting a resistance across the electrodes for detecting a remaining amount of ink, reference value storage means for storing a resistance value across the electrodes indicating that the ink tank contains sufficient ink as a reference value, resistance value comparison means for comparing the resistance value across the electrodes with the reference value, and suction control means responsive to a comparison result of the resistance values for controlling operation of said suction means, wherein if the resistance value from said resistance value detection means after ink tank replacement is smaller than the reference value, said suction control means holds said suction means inoperable.

18. An ink jet recording apparatus, comprising:

a recording head in communication with an ink tank through an ink supply member, said recording head being responsive to a print signal for spouting ink drops from nozzle openings to recording paper, capping means abutting against a front of said recording head for holding the nozzle openings in an airtight state, suction means for supplying negative pressure to said capping means and sucking ink in said capping means into a waste ink tank, and suction control means for causing said suction means to execute suction at a low flow rate and suction at a high flow rate.

19. The ink jet recording apparatus as claimed in claim 18, wherein when an ink tank is first mounted, suction at a low flow rate is first executed, and subsequently suction at a high flow rate is executed.

20. The ink jet recording apparatus as claimed in claim 18, wherein suction at a high flow rate is first executed, and subsequently a sequence of ink spout recovery operation steps including suction at a low flow rate is executed.

* * * * *